United States Patent [19]

Riffe et al.

[11] Patent Number: 4,927,339

[45] Date of Patent: May 22, 1990

[54] ROTATING SCROLL APPARATUS WITH AXIALLY BIASED SCROLL MEMBERS

[75] Inventors: Delmar R. Riffe; Peter A. Kotlarek, both of La Crosse; Robert E. Utter, Onalaska, all of Wis.

[73] Assignee: American Standard Inc., New York, N.Y.

[21] Appl. No.: 260,153

[22] Filed: Oct. 14, 1988

[51] Int. Cl.[5] ..... F01C 1/04; F01C 17/00; F01C 19/00; F01C 21/04

[52] U.S. Cl. ..... 418/55; 418/57; 418/109; 418/188; 464/105

[58] Field of Search ..... 418/55 B, 55 D, 55 E, 418/108, 109, 188, 57; 464/105

[56] References Cited

U.S. PATENT DOCUMENTS

| | | | |
|---|---|---|---|
| 801,182 | 10/1905 | Creux | 418/55 |
| 1,376,291 | 4/1921 | Rolkerr | 418/55 |
| 2,324,168 | 7/1943 | Montelius | 418/55 |
| 2,475,247 | 7/1949 | Mikulasek | 418/55 |
| 2,809,779 | 10/1957 | Girvin | 418/55 |
| 3,600,114 | 8/1971 | Dvorak et al. | 418/55 |
| 3,884,599 | 5/1975 | Young et al. | 418/55 |
| 3,989,422 | 11/1976 | Guttinger | 418/55 |
| 4,178,143 | 12/1979 | Thelen et al. | 418/19 |
| 4,192,152 | 3/1980 | Armstrong et al. | 62/402 |
| 4,477,239 | 10/1984 | Yoshii et al. | 418/55 |
| 4,496,296 | 1/1985 | Arai et al. | 418/55 |
| 4,534,718 | 8/1985 | Blain | 418/55 |
| 4,549,861 | 10/1985 | Blain | 418/55 |
| 4,551,078 | 11/1985 | Hiraga | 418/16 |
| 4,568,256 | 2/1986 | Blain | 418/55 |
| 4,575,318 | 3/1986 | Blain | 418/14 |
| 4,600,369 | 7/1986 | Blain | 418/55 |
| 4,610,610 | 9/1986 | Blain | 418/14 |
| 4,610,611 | 9/1986 | Blain | 418/55 |
| 4,611,975 | 9/1986 | Blain | 418/5 |
| 4,613,291 | 9/1986 | Sidransky | 418/15 |
| 4,753,582 | 6/1988 | Morishita et al. | 418/55 |

FOREIGN PATENT DOCUMENTS

| | | | |
|---|---|---|---|
| 637068 | 7/1969 | Czechoslovakia . | |
| 2160582 | 12/1971 | Fed. Rep. of Germany . | |
| 427656 | 6/1911 | France | 418/55 B |
| 980737 | 1/1951 | France . | |
| 63-80089 | 4/1988 | Japan . | |

*Primary Examiner*—John J. Vrablik

*Attorney, Agent, or Firm*—William J. Beres; David L. Polsley; William O'Driscoll

[57] ABSTRACT

In a co-rotating scroll apparatus wherein one scroll is a drive scroll and the other scroll is an idler scroll, an axial pressure balancing mechanism and means for discharge pressure balancing is disclosed. The drive scroll wrap is provided with an end plate having a plurality of extension members extending thereform. The extension members extend through corresponding slots in an Oldham coupling ring to drive the idler scroll in relative orbital rotation. The extension members further extend through clearance slots in the end plate of the idler scroll to secure a compression plate and spring biasing the end plate of the idler scroll toward the drive scroll to provide improved axial compliance between the scrolls. Means for axial pressure balancing of the idler scroll shaft and the drive scroll drive shaft are disclosed. The apparatus also includes axial thrust bearings for preventing axial oscillations of the drive and idler scrolls.

170 Claims, 14 Drawing Sheets

FIG. 11
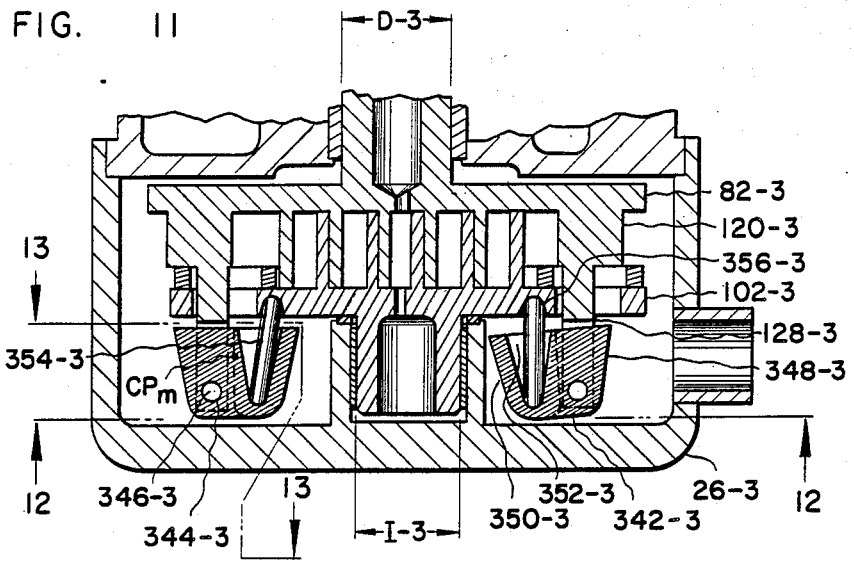
FIG. 12
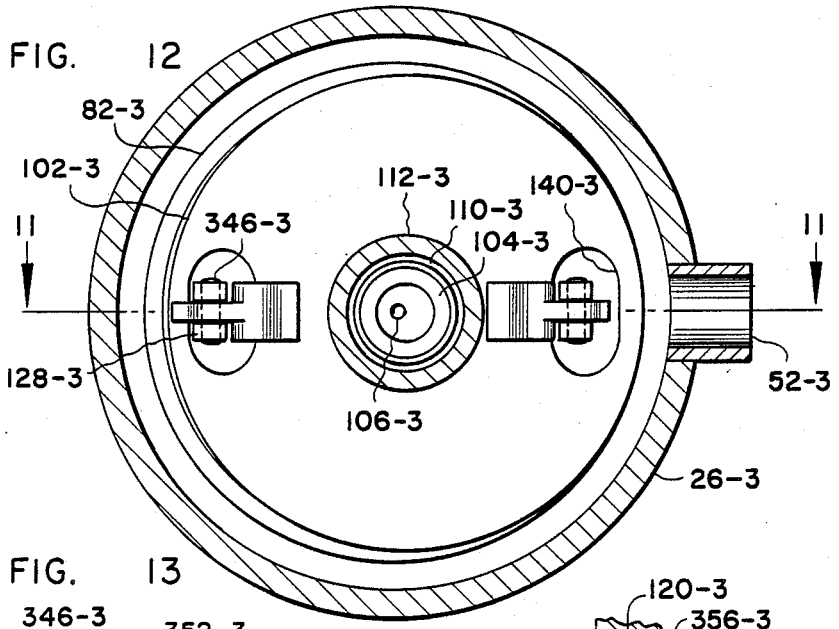
FIG. 13
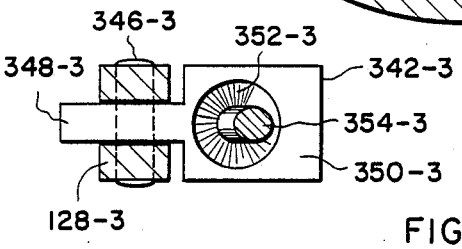
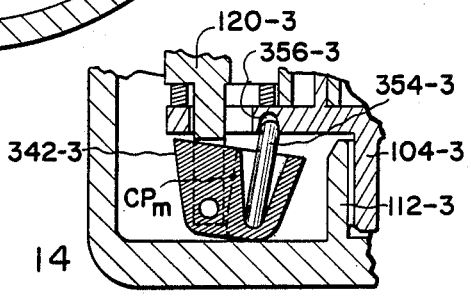
FIG. 14

ROTATING SCROLL APPARATUS WITH AXIALLY BIASED SCROLL MEMBERS

DESCRIPTION

1. Technical Field

This invention generally pertains to scroll apparatus and specifically to co-rotating scroll-type fluid apparatus having improved axial compliance means.

2. Background Art

Scroll apparatus for fluid compression or expansion are typically comprised of two upstanding interfitting involute spirodal wraps which are generated about respective axes. Each respective involute wrap is mounted upon an end plate and has a tip disposed in contact or near-contact with the end plate of the other respective scroll wrap. Each scroll wrap further has flank surfaces which adjoin in moving line contact, or rear contact, the flank surfaces of the other respective scroll wrap to form a plurality of moving chambers. Depending upon the relative orbital motion of the scroll wraps, the chambers move from the radial exterior end of the scroll wraps to the radially interior ends of the scroll wraps for fluid compression, or from the radially interior ends of the respective scroll wraps for fluid expansion. The scroll wraps, to accomplish the formation of the chambers, are put in relative orbital motion by a drive mechanism which constrains the scrolls to non-rotational motion. The general principles of scroll wrap generation and operation are discussed in numerous patents, such as U.S. Pat. No. 801,182.

In typical scroll apparatus, one scroll wrap is secured to a fixed end plate while the other respective scroll wrap end plate is driven in a relative orbital motion. This is accomplished by providing a shaft having an eccentric crank for engaging the end plate of the orbiting scroll wrap. Because of manufacturing tolerance limitations, and for accomplishing radial compliance to permit foreign debris or fluid to flow through the scroll apparatus without damaging the apparatus, it is usually necessary to provide a compliance mechanism. The radial compliance mechanism usually takes the form of a slider block engaged by the crankshaft and interfitting a slot in the crankshaft or end plate for transferring rotary motion, or alternatively, a swing link for engaging the crank portion of the drive shaft and a drive stub of the orbiting end plate for the transference of orbiting motion. As the radial compliance mechanism rotates with the eccentric crank portion of the drive shaft, an undesirable load is placed upon the drive shaft bearings which must be countermanded by unduly large drive shaft bearings and counterbalancing weights or other means. Furthermore, the radial compliance mechanism unduly adds to the complexity of the compressor structure, thus increasing maintenance requirements and manufacturing costs undesirably.

The typical scroll apparatus also includes a thrust bearing acting upon the surface of the orbiting, drive scroll end plate opposed from the involute scroll wrap for ensuring axial compliance or axial engagement of the scroll tips with the opposing scroll end plates which would otherwise be lost due to the pressure of fluid between the scroll end plates. Appropriate axial contact is necessary to ensure that undue leakage does not occur between the scroll tips and the opposing scroll end plates thereby losing the compression or expansion effectiveness of the apparatus. This thrust bearing causes undesirable power loss, and therefore it is desirable to minimize the thrust load which must be absorbed by this bearing. However, in the scroll type apparatus with an eccentrically driven orbiting scroll, it is difficult to minimize the size of the thrust bearing as desired because of the uneven loading experienced by the thrust bearing as the scroll moves about its orbit.

Finally, the typical scroll apparatus having a fixed involute wrap requires the use of an anti-rotation device, such as an Oldham ring coupling to prevent rotation and constrain to orbital motion the drive scroll member. Again, it is desirable to minimize the load transmitted through the anti-rotation device to minimize power loss in the scroll apparatus.

Numerous attempts have been made to overcome these objections, such as the provision of fluid pressure biasing in lieu of a thrust bearing on the orbiting scroll member, and the use of an eccentric crank which directly engages an orbiting scroll without the use of a radial compliance member. These attempts have met with only moderate success. For example, the biasing of the orbiting scroll by intermediate or high pressure fluid requires the inclusion of several additional seals or gaskets to prevent or minimize fluid leakage, all of which are subject to wear and are unduly expensive and difficult to maintain. The removal of the radial compliance mechanism requires that the scroll apparatus be manufactured to a high accuracy which is unduly expensive and consuming. The removal of this mechanism also subjects the compression to potential damage from foreign objects moving through the machine. This is not acceptable for machines which must be mass produced, must provide high reliability, and must be relatively inexpensive.

There have been sporadic attempts to develop scroll apparatus which have co-rotating scrolls. Such apparatus provides for concurrent rotary motion of both scroll wraps on parallel, offset axis. However, there have been difficulties in achieving success with these co-rotating scroll apparatus. Typically, a large number of additional rotary bearings are required, which decreases the reliability of the machine. Furthermore, the typical co-rotating scroll apparatus have required a thrust bearing acting upon each of the scroll end plates to prevent axial scroll separation, thus substantially increasing the power requirements of the machine as well as substantially reducing the reliability of the machine. Therefore, these apparatus have not been substantially successful to date.

Therefore it is an object of the present invention to provide an efficient co-rotating scroll apparatus.

It is still a further object of the present invention to provide such a co-rotating scroll apparatus as is suitable for mass production.

It is a further object of the present invention to provide a co-rotating scroll apparatus which is of simple construction and high reliability.

Finally, it is an object of the present invention to provide a scroll apparatus which is relatively compliant and not susceptible to damage in operation.

These and other objects of the present invention will be apparent from the attached drawings and the description of the preferred embodiment that follows hereinbelow.

SUMMARY OF THE INVENTION

The subject invention is a co-rotational scroll apparatus having two concurrently rotating scroll elements interrelated by an orbiting motion thrust bearing means ensuring appropriate axial compliance of the scroll elements while preventing non-concurrent rotation. The scroll apparatus further includes a means for radial adjustment of the scroll elements to ensure appropriate radial clearance between the flanks of the scroll wraps. An annular seal and seal spring is provided in the scroll apparatus for preventing undesirable axial fluctuation of the scroll elements when in operation. Finally, the scroll apparatus includes lubricant passages for efficient transfer of lubricant to the moving members of the scroll apparatus.

Specifically, the scroll apparatus includes a motor acting through a drive shaft to rotate a drive scroll end plate and two extension members extending from the drive scroll end plate through appropriate drive slots in a spacing ring which acts as an Oldham Coupling, engaging two upstanding rectilinear keys on the idler scroll end plate to ensure concurrent rotary motion of the idler and drive scroll end plates. As the scroll end plates are rotated about parallel, non-concentric axes a relative orbital motion is induced between respective scroll wraps on the scroll end plates. Preferably, the extension members extend beyond the idler scroll end plate through clearance slots to mount a pressure plate, and a biasing member such as a coil spring extends between the pressure plate and the idler scroll end plate to ensure appropriate axial contact of the scroll wraps with the respective opposing end plates. The biasing spring also permits axial compliance of the scroll wraps and end plates so that foreign matter or fluid slugging through the scroll apparatus will not damage the scroll apparatus.

BRIEF DESCRIPTION OF THE DRAWINGS

FIG. 11 shows an enlarged partial cross-sectional view of the scroll apparatus in a third alternative embodiment.

FIG. 12 shows a cross-sectional view of the alternative embodiment of FIG. 11 taken along section line 12—12 of FIG. 11.

FIG. 13 shows a cross-sectional view of the biasing mechanism of the alternative embodiment of FIG. 11 taken along section line 13—13 of FIG. 11.

FIG. 14 shows a partial cross-sectional view of the scroll apparatus of the alternative embodiment of FIG. 11 in a non-operating position.

DESCRIPTION OF THE PREFERRED EMBODIMENTS

Figure 1:
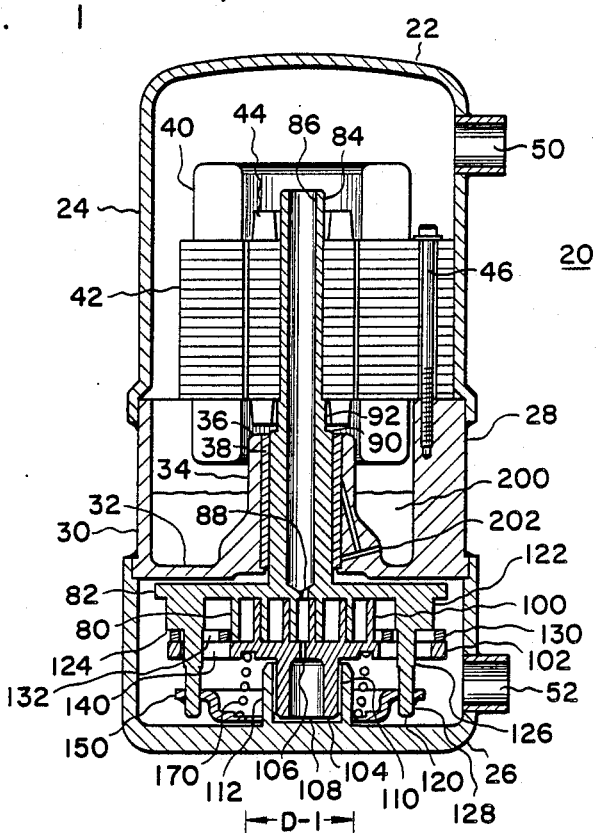
FIG. 1 shows a cross-sectional view of a co-rotational scroll fluid apparatus embodying the subject invention.

A scroll-type fluid apparatus generally shown in FIG. 1 as a scroll compressor assembly is referred to by reference numeral 20. As the preferred embodiment of the subject invention is a hermetic scroll compressor assembly, the scroll apparatus 20 is interchangably referred to as a compressor assembly 20. It will be readily apparent that the features of the subject invention will lend themselves equally readily to use as a fluid expander, a fluid pump, or to scroll apparatus which are not of the hermetic type.

In the preferred embodiment, the compressor assembly 20 includes a hermetic shell 22 having an upper portion 24, a lower portion 26 and an intermediate, central frame portion 28. The central frame portion 28 is defined by a generally cylindrical exterior shell 30 having a central frame portion 32 disposed across one end thereof.

Integral with the central frame portion 32 is a generally cylindrical upper bearing housing 34, which is substantially co-axial with the axis of the exterior shell portion 30. A drive shaft aperture 36 extends axially through the center of the upper bearing housing 34, and an upper main bearing 38 is disposed radially within the drive shaft receiving aperture 36. Preferably, the upper main bearing 38 is a rotation bearing made, for example, of sintered bronze or similar material. The upper main bearing 38 may also be of the roller or ball-type bearing. The upper main bearing 38 does not preferably provide thrust load bearing capability.

A motor 40 is disposed within the upper portion 24 and central shell portion 28 of the hermetic shell 22. The motor 40 is preferably a single-phase or three-phase electric motor comprised of a stator 42 which is circumferentially disposed about a rotor 44, with an annular space therebetween permitting free rotation of the rotor 44 within the stator 42. A plurality of long bolts or cap screws 46 are provided through appropriate apertures in the stator plates into threaded apertures in the intermediate shell portion 28 for securing the motor within the hermetic shell 22. For clarity, only one of the long bolts 46 is shown.

It will be readily apparent to those skilled in the art that alternative types of motors 40 and means of mounting the motor 40 would be equally suitable for application in the subject invention.

A discharge aperture 50 is shown in the upper shell portion 24 for discharging high pressure fluid from the scroll apparatus, and a shell suction aperture 52 is shown disposed in the lower end of the lower shell portion 26 for receiving low pressure fluid into the scroll apparatus. This permits connection of the scroll apparatus 20 to a suitable fluid system.

Figure 17:
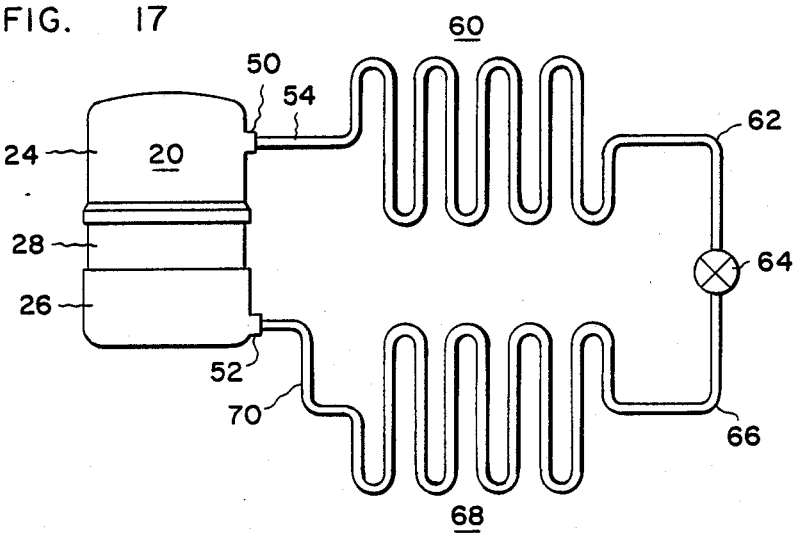
FIG. 17 shows in schematic representation a refrigeration or air conditioning system in which the subject invention could be suitably employed.

Preferably, the scroll compressor assembly 20 would be connected to a refrigeration or air conditioning system. The refrigeration system, shown generally in schematic representation in FIG. 17, includes a discharge line 54 connected between the shell discharge aperture 50 and a condenser 60 for expelling heat from the refrigeration system and condensing the refrigerant. A line 62 connects the condenser to an expansion valve 64. The expansion valve may be thermally actuated or electrically actuated in response to a suitable controller (not shown). Another line 66 connects the expansion valve 64 to an evaporator 68 for transferring expanded refrigerant from the expansion valve to the evaporator for acceptance of heat. Finally, a refrigeration system suction line 70 transfers the evaporated refrigerant from the evaporator 68 to the compressor assembly 20, wherein the refrigerant is compressed and returned to the refrigeration system.

It is believed that the general principles of refrigeration systems capable of using such a compressor system 20 are well understood in the art, and that detailed explanation of the devices and mechanisms suitable for constructing such a refrigeration system need not be discussed in detail herein. It is believed that it will also be apparent to those skilled in the art that such a refrigeration or air conditioning system may include multiple units of the compressor assembly 20 in parallel or series connections, as well as multiple condensers or evaporators and other components, hence such embodiments of refrigeration systems need not be discussed here in detail.

Having described the general construction of the compressor assembly 20, the features of the present invention are now described in more detail. Referring again to FIG. 1 and more particularly to FIGS. 2 and 3, a scroll arrangement having a first and a second scroll member is disclosed, comprised of two upstanding, interfitting involute scroll wraps. The first scroll member includes an upstanding first involute scroll wrap 80 which is integral with a generally planar drive scroll end plate 82. The drive scroll end plate 82 includes a central drive shaft 84 extending oppositely the upstanding involute scroll wrap 80. A discharge gallery 86 is defined by a bore extending centrally through the axis of the drive shaft 84. The discharge gallery 86 is in flow communication with a discharge aperture 88 defined by a generally central bore through the drive scroll end plate 82. The drive shaft 84 includes a first, relatively larger diameter portion 90 extending axially through the upper main bearing 38 for a free rotational fit therein, and a second relatively smaller diameter portion 92 which extends axially through the rotor 44 and is affixed thereto. The rotor 44 may be affixed to the rotor portion 92 of the drive shaft 84 by such means as a press fit or a power transmitting key in juxtaposed keyways.

The second or idler scroll member includes a second, idler scroll wrap 100 is disposed in interfitting contact with the driven scroll wrap 80. The idler scroll wrap 100 is an upstanding involute extending from an idler end plate 102. Two rectilinear idler drive key stubs 103 extend upwardly on the idler end plate 102. The idler key stubs 103 are disposed at radially opposed positions outside the idler scroll wrap 100. An idler shaft stub 104 extends from the idler end plate 102 oppositely the idler scroll wrap 100. The idler end plate 102 further includes a generally central pressure transmission bore 106 in flow communication with a pressure balance chamber 108 defined by a bore in the idler shaft stub 104.

An annular bearing 110, which may be a sleeve bearing made of a sintered bronze material or may be of the roller or ball type, is disposed within an annular wall defining an idler bearing housing 112 which is integral with the lower hermetic shell portion 26 for rotationally supporting the idler scroll end plate 102 and idler scroll wrap 100.

The drive scroll end plate 82 also includes two extension members 120 extending from the drive scroll end plate 82 parallel the drive scroll wrap 80. The extension members 120 are disposed at radially opposed positions near the outer edge of the drive scroll end plate 82, and are each comprised of three portions or sections: a first, spacing portion 122 concludes in a generally planar shoulder 124 spaced a certain distance from and co-planar with the drive scroll end plate 82; a second, rectilinear key portion 126; and a third, retainer portion 128.

A ring 130 is disposed between and in sliding contact with the shoulders 124 of the extension members 120 and the idler end plate 102. The ring 130 thus serves as a spacer and prevents undesirable oscillation or nutation of the idler end plate 102 with respect to the drive scroll end plate 82. The ring 130 is annular in form, extending noncontactingly about the radial exterior of the scroll wraps 80 and 100 and further having four rectilinear drive key slots **132*a* to 132*d* defined through the ring 130 at equidistant intervals of approximately 90° about the annular body of the ring to comprise two pairs of oppositely disposed slots 132, with slots 132*a* and 132*c* being one pair and slots 132*b* and 132*d* being the second pair. As shown particularly in FIG. 3, the ring 130 includes four generally rectilinear broadened portions through which the slots 132 are defined so that the slots 132 may be of the desired size with the body of the ring 130 being minimized. It is, of course, equally possible to form the ring with a radial thickness exceeding that required for the slots 132. However, the form depicted in FIG. 3 minimizes the mass of the ring 130 and aids in obtaining the desirable result of reducing the mass of the rotating portion of the scroll apparatus, as the ring 130** is preferably made of steel or a similar material.

In the scroll apparatus, the second key portion 126 of the extension members 120 extend through the drive slots 132*a* and 132*c* in sliding engagement with the ring 130, while the third portion 128 of the extension members 120 extend beyond the ring 130. The idler key stubs 103 extend upward from the idler end plate into the drive key slots 132*b* and 132*d* into sliding engagement therewith. During operation of the scroll apparatus, the ring 130 therefore acts as an Oldham Coupling means for transferring rotation and torque from the extension members 120 through the ring 130 to the idler key stubs 103 and thereby cause simultaneous rotation of the respective scroll members 80 and 100.

The idler end plate 102 further includes about its exterior two clearance slots 140 which are concomitant with the drive key slots 132*a* and 132*c*. The clearance slots 140 are disposed at the radially outward end 142 of the idler end plate 102 so that the third, retainer portion 128 of the extension members 120 extends through the clearance slots 140 parallel to, but radially outward of, the lower bearing housing 112. The clearance slots 140 are sized to provide sufficient clearance to prevent interference between the third, retainer portion 126 and the idler end plate 102 during the operation of the scroll apparatus.

An annular plate, the first scroll member compression plate 150, is affixed to the cylindrical portions 128 of the extension members 120. The compression plate 150 has an annular, generally planar circumferential portion 152 about the radially outward end thereof. This radially outward portion includes one hole for each extension member 120, wherein the third, retainer cylindrical portion 128 is fixed. The retainer portion 128 may be affixed in the hole by such means as welding, a press fit or a rotation-interlock fit between the components. A depressed planar central portion 156 is parallel and downwardly spaced a distance from the outer end portion 152 of the compression plate 150. This central portion 156 preferably includes a second, slightly more downwardly spaced area describing a retaining shoulder 158 and a biasing surface 160. A central aperture 162 is described by a bore through the axial center of the depressed portion 156. This central aperture 162 is of sufficient diameter to freely rotate about the lower bearing housing 112.

A compression spring 170 is disposed between the compression plate 150 and the idler end plate 102. The compression spring 170 serves as a biasing element to force the respective scroll end plates 82 and 102 toward each other. The compression spring 170 exerts a force on the idler end plate 102 opposite from the idler scroll wrap 100 urging the tip 180 of the idler scroll wrap into contact with the drive scroll end plate 82, and transmits a like, opposing force through the compression plate 150, extension members 120 and driven end plate 82 to urge the driven scroll wrap tips 182 into contact with the idler scroll end plate 102. In the preferred embodiment, an annular channel 114 is concentrically disposed about the idler end plate 102 for receiving an end of the spring 170.

The scroll assembly thus comprised of the respective scroll end plates 82 and 102, together with the extension members 120, the compression plate 150 and the compression spring 170 provides the compressor assembly 20 with an axially complaint scroll assembly. In the event of excessive pressure or fluid slugging between the scroll wraps 80 and 100, the axial biasing force generated by the compression spring 170 is overcome and the pressure is relieved or fluid permited to pass by leakage flow between the respective scroll tips 180 and 182 and the opposing end plates 82 and 102.

Referring now to FIGS. 4, 4A, 5 and 6, it may be seen that the drive shaft 84 rotates the drive scroll end plate 82 about a first axis A and that the idler shaft 104 rotates the idler end plate 102 about a second axis B. The first axis A is parallel to but not concentric with the second axis B. Since the axes A and B are non-concentric, the respective scroll wraps 80 and 100 carried on the respective end plates 82 and 102 move in a relative orbital motion when rotated synchronously.

Figure 4:
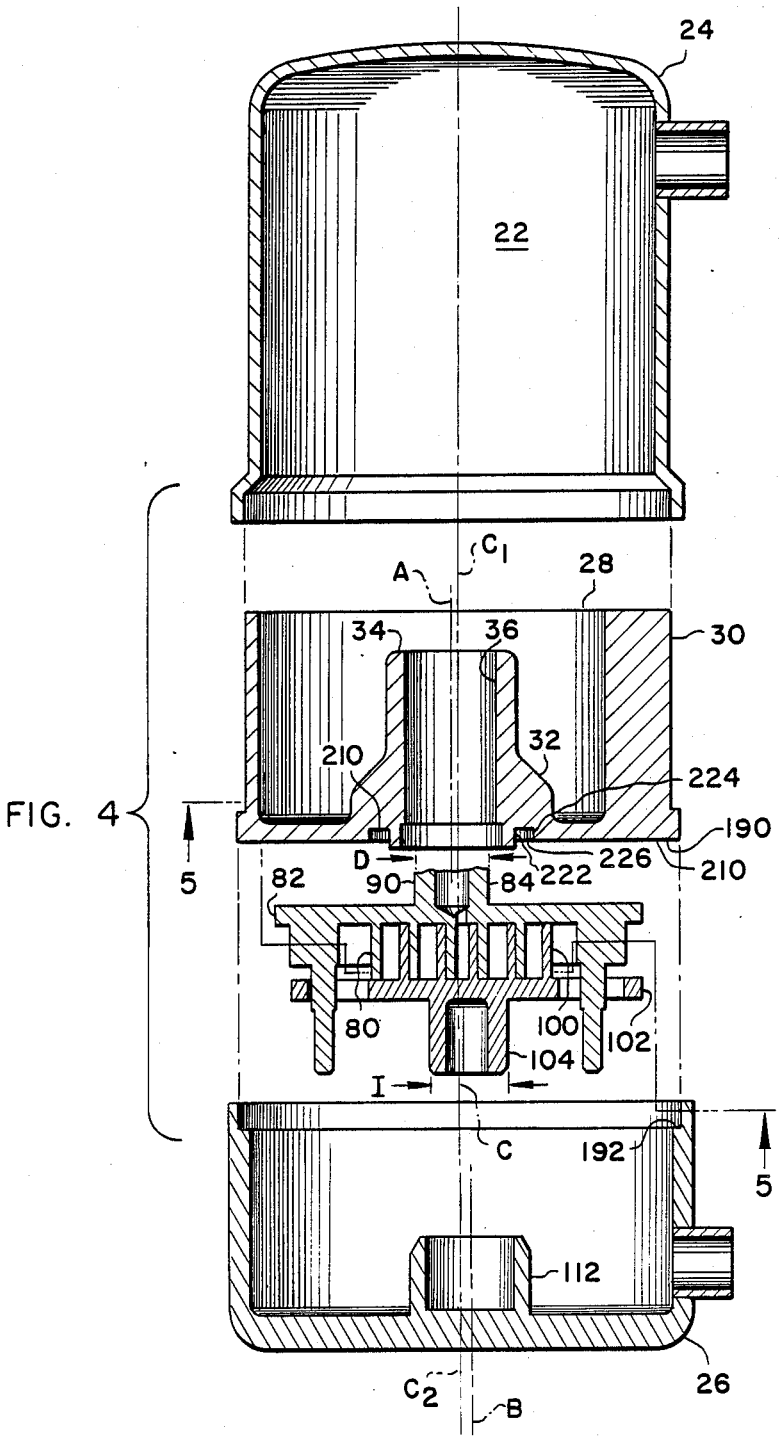
FIG. 4 shows an exploded cross-sectional view of the hermetic shell components and the scroll apparatus of the subject invention.
Figure 4A:
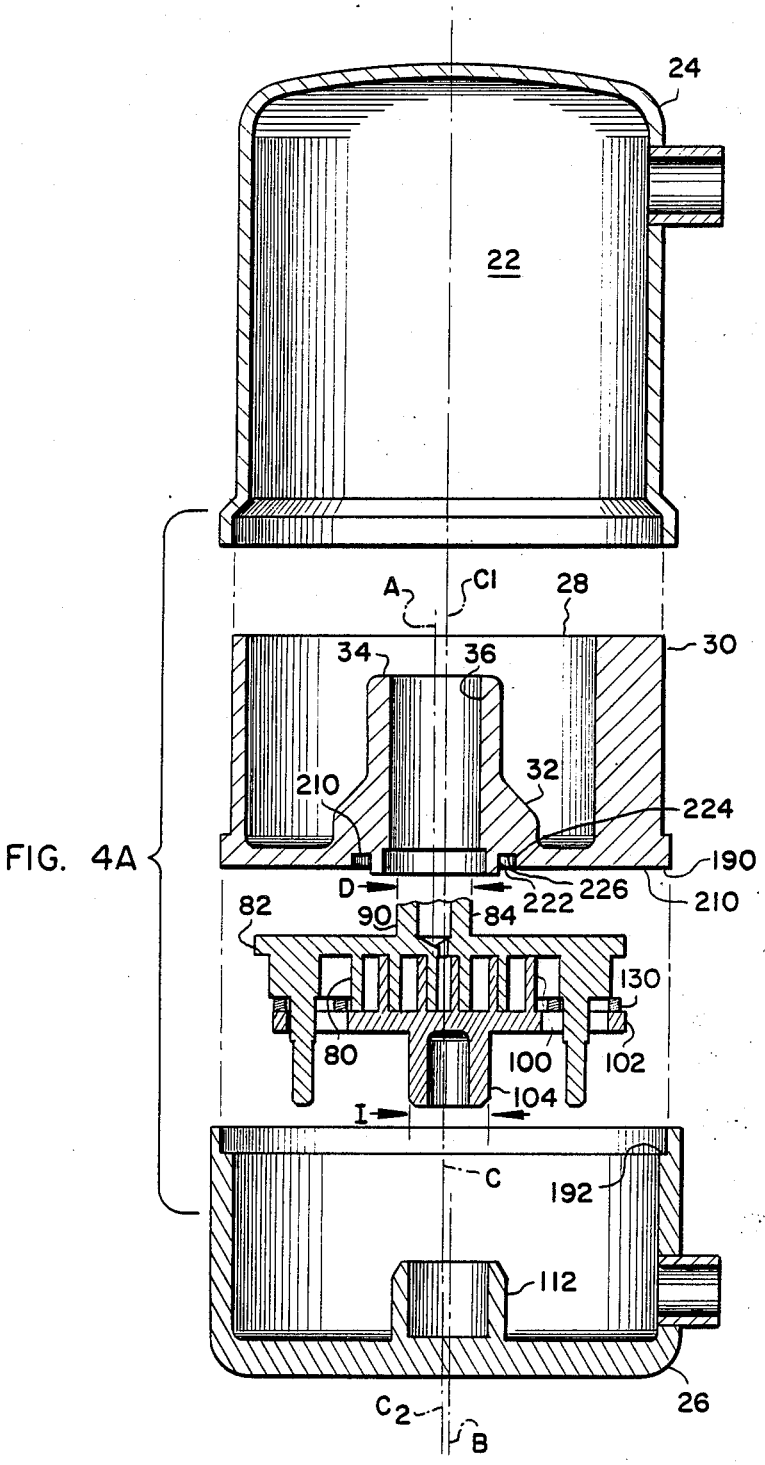
FIG. 4A discloses in an exploded cross-sectional view an alternative disposition of the hermetic shell components and the scroll apparatus of the subject invention.

A cylindrical lip 190 is generated at the lower end of the central shell portion 28 about a first axis of generation $C_1$. The lower shell portion 26 includes a cylindrical lower shell shoulder 192 defined in the upper edge. This lower shell shoulder 192 is generated about a second axis of generation $C_2$. The axis A of the drive shaft 84 is offset from the axis of generation $C_1$ in the central shell portion 28, preferably by a relatively small amount, such as 0.015 to 0.020 inches. The axis B of the idler shaft 104 is also offset from the axis of generation $C_2$ in the lower shell portion 26, but preferably by a larger amount of offset than the offset between the axes A and $C_1$, for example, in an amount approximately equal to the orbit radius defined by the scroll wraps 80 and 100, as particularly shown in FIG. 4. FIG. 4A shows the alternative embodiment wherein the axis B of the idler shaft 104 is offset from the axis of generation $C_2$ by a smaller amount that the offset of the axis A from $C_1$.

During assembly of the hermetic shell 22, the central shell lip 190 engages the lower shell shoulder 192. The lower shell shoulder 192 fits closely about the exterior of the central shell lip 190. Preferably, the lower shell shoulder 192 and the central shell lip 190 are sized to permit a close fit therebetween suitable for welding. The axis of generation $C_1$ of the central shell portion 28 and the axis of generation $C_2$ of the lower shell portion are concentric after assembly of the hermetic shell 22, comprising a single axis C (i.e., $C=C_1=C_2$), which is offset from both the axis A and B. The lower shell portion 26 and the central shell portion 28 are relatively positionable during the assembly of the hermetic shell 22 to adjust the flank clearance between the respective scroll wraps 80 and 100. Indicator markings such as U for the central shell portion 28 and L for the lower shell portion 26 may be provided to visually indicate, for ease of assembly, the relative position of the respective shell portions about the common axis C.

Figure 5:
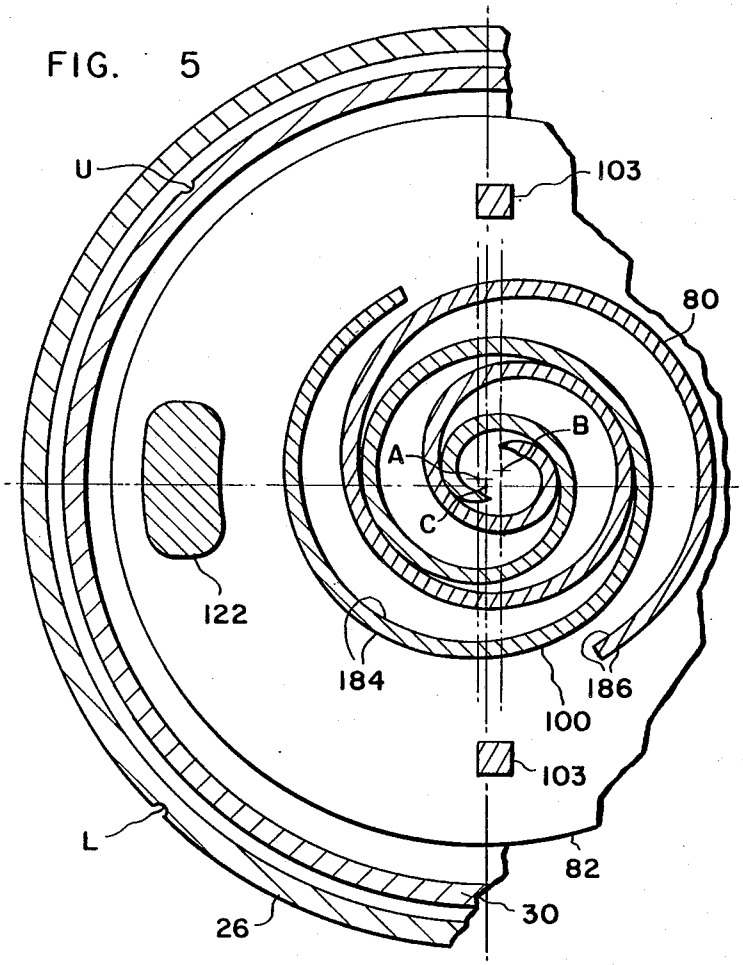
FIG. 5 shows a cross-sectional view of the scroll apparatus in one disposition of the shell components taken through section line 5—5 of FIG. 4.
Figure 6:
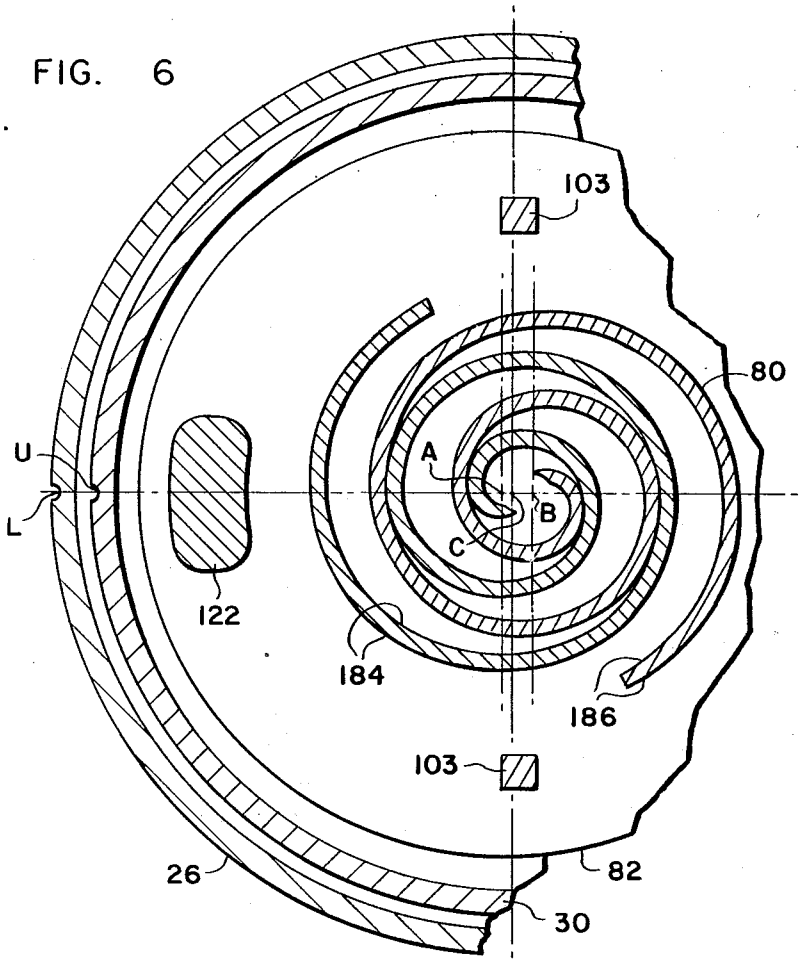
FIG. 6 shows a second disposition of the scroll apparatus in a second disposition of the hermetic shell components of the subject invention taken along section line 5—5 of FIG. 4.

FIGS. 5 and 6 more clearly show the results of positioning of the central shell portion 28 with respect to the lower shell portion 26. The maximum orbit radius between the respective scroll wraps 80 and 100 is equal to the distance that A is removed from C plus the distance that B is removed from C and the minimum orbit radius is equal to the distance that B is removed from C less the difference that A is removed from C. Orbit radius as used herein should be understood to refer to the offset of or relative orbit distance defined between the scroll wrap elements 80 and 100. As the scroll wrap flank surfaces 184 of the idler scroll wrap contact the flank surfaces 186 of the driven scroll wrap 80, it is necessary to provide an appropriate clearance between the respective flanks 184 and 186 to prevent excessive leakage and loss of efficiency or conversely excessive wear to the flank surfaces due to lack of appropriate flank clearance. The appropriate flank clearance is obtained by adjusting the orbit radius according to the foregoing formula during assembly of the compressor assembly 20, positioning the central shell lip 190 with respect to the lower shell shoulder 192 prior to welding or otherwise finally assembling the hermetic shell 22.

In operation, the motor 40 of the compressor assembly 20 is connected to an appropriate electrical supply and actuated to cause rotation of the rotor 44. The rotor 44 in turn rotates the drive shaft 84, driving the driven end plate 82. The extension members 120, slidingly engaged in the drive key slots 132 of the ring 130, cause concurrent rotation of the idler scroll end plate 102 with the drive scroll end plate 82. The drive shaft 84 rotates about the axis A and the idler scroll end plate 102 rotates about the axis B on the idler shaft stub 104. Because the axis A and B are non-concentric, a relative orbital motion is set up between the driven scroll wrap 80 and the idler scroll wrap 100, causing a plurality of chambers to be formed between the idler scroll flanks 184 and the driven scroll flanks 186, which are in moving line contact. These chambers are of decreasing volume toward the radially inward ends of the respective scroll wraps 80 and 100, such that the fluid is drawn into the chambers as they form at the radially outward ends of the respective scroll wraps 80 and 100 and compressed as it is moved toward the radially inward ends of the respective scroll wraps 80 and 100.

The compressed fluid is then discharged from the scroll wraps through discharge aperture 88 and thence through the discharge gallery 86 into the discharge pressure portion of the hermetic shell defined in the upper shell portion 24. Simultaneously, a portion of the compressed, discharge pressure fluid enters the pressure balance chamber 108 through the pressure transmission bore 106. The discharge pressure fluid in the pressure balance chamber 108 acts to force the idler scroll shaft stub 104 axially from the lower bearing housing 112. This force is in opposition to a simultaneous force of discharge pressure fluid acting upon the drive shaft 84 to axially force the drive shaft 84 toward the idler end plate 102.

Lubrication of the bearings 38 and 110, as well as the other components of the compressor assembly 20, is accomplished by a depression in the central frame portion 32 which acts as a reservoir 200 for lubricant within the hermetic shell 22. Lubricant is transferred from the reservoir 200 to the upper main bearing 38 through a lubricant passage 202 in the central frame passage extending between the reservior 200 and the upper main bearing 38. Lubricant is preferably forced through the passage 202 by the action on its surface of discharge pressure fluid, the lubricant passing through the lubricant passage 202 to the main bearing 38 and hence to the suction pressure portion defined by the lower shell portion 26. The lubricant accumulating in the suction pressure portion of the compressor assembly 20 is entrained into the suction pressure fluid and drawn through the scroll assembly, lubricating the moving parts and being compressed and discharged with the fluid. The lubricant is then disentrained int he discharge pressure portion of the hermetic shell 22 defined by the upper shell portion 24 and the central shell portion 28, flowing downwardly through the annular space between the rotor 44 and stator 42 and about the exterior of the stator 42 to return to the lubricant reservoir 200.

The amount of force exerted upon the idler scroll end plate 102 by the drive shaft 84 and the amount of force exerted upon the drive scroll end plate 82 by the action of discharge pressure upon the idler scroll shaft stub 104 is determined by the plan view areas of the respective shafts and therefore by the relative sizing of the diameters of these shafts. The drive shaft 84 has a plan view area diameter D and the idler shaft stub 104 has a plan view area diameter I. As the compressor assembly 20 is preferably oriented with a vertical axis having the motor 40 disposed above the scrolls 80 and 100, the diameters D and I can be calculated according to the capacities and component weights of the particular machine. For example, D and I may be made equal, so that the weight of the scrolls 80 and 100, the drive shaft 84 and the rotor 44 is transmitted to the lower main bearing 110.

Alternately, the diameter I may be made larger than the diameter D so that the weight of the scrolls 80 and 100, the drive shaft 84 and the rotor 44 will be supported by the action of discharge pressure fluid upon the idler shaft stub 104, obviating the need for a thrust bearing in the lower bearing housing 112. Also, it would be possible to expose the plan view area of diameter I to an intermediate pressure fluid for a lesser pressure balancing effect. Finally, the value of I may be made larger than the diameter D to the extent that the force exerted by the idler shaft stub 104 exceeds that exerted by the action of discharge pressure fluid upon the drive shaft 84 and the combined weight of the scrolls 80 and 100, the drive shaft 84 and the rotor 44, in which case some provision for accepting a thrust load will be necessary in the driven scroll 80 or in the upper main bearing 38. Examples of these alternatives will appear in alternative embodiments of the subject invention, however, in the preferred embodiment the diameter I is slightly larger than the diameter D so as to balance the weight of the scrolls 80 and 100, the drive shaft 84 and the rotor 44 when in operation.

It should be noted that when the same part or feature is shown in more than one of the figures, it will be labeled with the corresponding reference numeral to aid in the understanding of the subject invention. Furthermore, reference should be had to all of the figures necessary to aid in the understanding of the specification even where a particular figure is referred to, as all reference numerals are not displayed in all figures in order to minimize confusion. When the same part or feature appears in a figure representing or disclosing an alternative embodiment of that part or feature, it is again labeled with the same reference numeral, followed by a numeric suffix to correspond with the designation of that alternative embodiment in the specification. The numeric designation of the alternate embodiment does not correspond to its preference but rather is intended to aid in the understanding of the subject invention.

It should also be noted that the scroll apparatus can function as an expansion engine or as a fluid compression apparatus by directing fluid into the discharge pressure port to be expanded from the radially inward ends to the radially outward ends of the respective scroll wraps 80 and 100. This can be accomplished simply by establishing the appropriate direction of rotation with respect to the orientation of the scroll wrap involutes.

Figure 7:
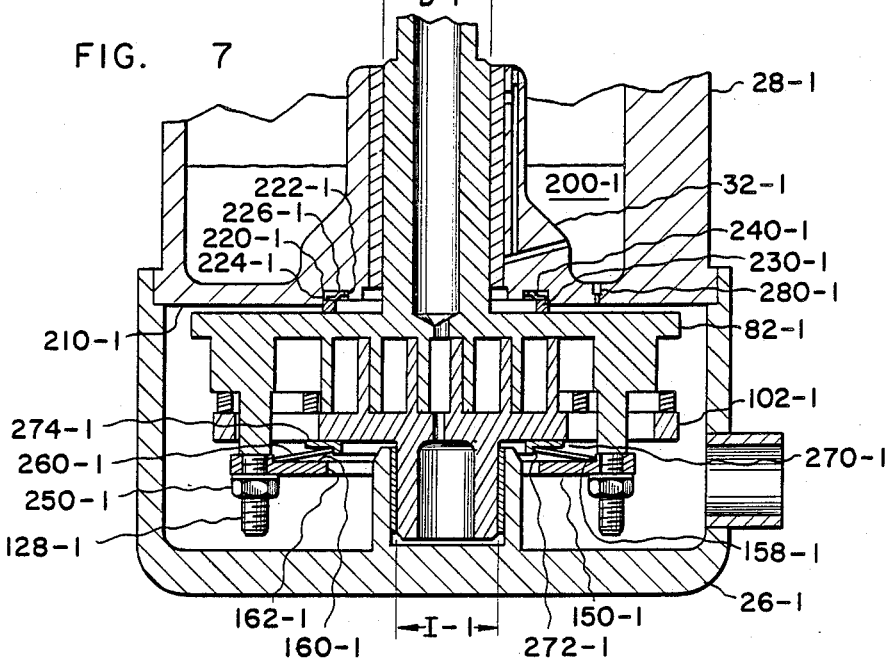
FIG. 7 shows an enlarged partial cross-sectional view of the scroll apparatus in a first alternative embodiment of the subject invention.
Figure 7A:
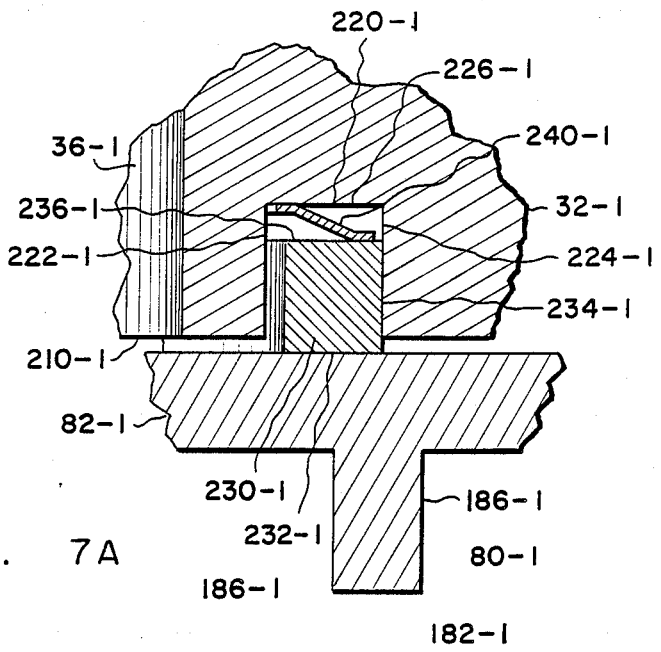
FIG. 7A shows an enlarged cross-sectional view of the oscillation limiting thrust bearing of FIG. 7.
Figure 7B:
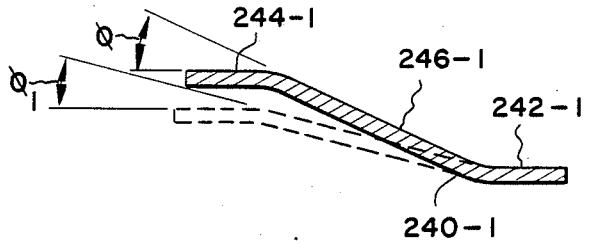
FIG. 7B shows a cross-sectional view of the annular spring of FIG. 7A.

Turning now to FIGS. 7, 7A and 7B, a first alternative embodiment of the subject invention is disclosed. This first alternative embodiment includes a lower face 210-1 in the central frame portion 32-1 having an annular groove 220-1 defined concentrically about and radially removed from the drive shaft 84-1. This annular groove 220-1 is defined by a circular interior side wall 222-1, a concentric exterior side wall 224-1 of relatively larger diameter and a recessed planar surface 226-1 in the base of the groove 220-1 adjoining the interior side wall 222-1 and the exterior side wall 224-1.

An annular bearing 230-1 of rectangular cross-section is disposed within the annular groove 220-1. The annular bearing 231-1, as shown more particularly in FIG. 7A, includes a first planar surface 232-1 for engaging the driven scroll end plate 82-1 and a second, exterior surface 234-1 for engagement with the exterior side wall 224-1. A third engagement face 236-1 is at the upper end of the second surface 234-1 and is parallel to the first surface 232-1, whereas the second surface 224-1 is normal to and extends between the first surface 232-1 and the third surface 236-1.

An annular thrust spring 240-1, as shown in FIGS. 7–7B, is disposed between the third surface 236-1 of the annular bearing 230-1 and the recessed surface 226-1 of the annular groove 220-1. The annular spring 240-1 is comprised of three portions; a first, relatively planar radially exterior portion 242-1, a second radially interior planar portion 244-1 and an angular portion 246-1 adjoining the exterior planar portion 242-1 and the interior portion 244-1. The exterior planar portion 242-1 and the interior planar portion 244-1 are parallel and spaced apart a distance determined by an angle theta of the angular portion 246-1. Preferably, the annular spring 240 is a solid annulus having no holes or discontinuities. The annular spring 240-1 may, for example, be formed of spring steel by such means as die-press operations.

Preferably, the second surface 234-1 of the annular bearing 230-1 is sized to a diameter slightly larger than the exterior side wall 224-1 of the annular groove 220-1 to cause a slight compression in contact therebetween. The annular spring 240-1 is disposed between the annular bearing 230-1 and the annular groove 220-1, with the interior planar portion 244-1 in contact with the recessed surface 226-1 and the exterior planar portion 242-1 in biasing contact with the third face 236-1 of the annular bearing 230-1. In order to achieve the appropriate biasing effect of the thrust spring 240-1 in the assembled compressor assembly 20-1, the lower base 210-1 should be within 0.020 to 0.040 inches of the driven scroll end plate 82-1 when the compressor assembly 20-1 is operating, although this will vary according to the compressor component sizing.

When the compressor assembly 20-1 is assembled, the idler scroll shaft stub is placed in the lower main bearing 110-1, and the central shell lip 192-1 is placed into engagement with the lower shell shoulder 190-1, causing the annular bearing 230-1 to contact the driven scroll end plate 82-1. This contact causes the annular spring 240-1 to become biased so that the angle theta of the angular poriton 246-1 is moved to the angle $theta_1$, as seen in FIG. 7B. In this first alternative embodiment, the diameter I-1 is larger than the diameter D-1 so that the force of discharge fluid acting upon the idler scroll shaft stub 104-1 biases the scroll assembly 80-1 and 100-1 toward the annular bearing 230-1. This annular bearing assembly 230-1 and 240-1 would be useful in a compressor assembly 20-1 experiencing substantial variations in load condition which might cause axial oscillation of the scroll assembly 80-1 and 100-1.

Also, in the first alternative embodiment, the exterior of the cylindrical portion 128-1 of the extension member 120-1 is threaded to accept retaining nuts 250-1. The threaded cylindrical portions 128-1 extend through corresponding holes in a planar compression plate 150-1. The compression plate 150-1 has a relatively slightly depressed planar biasing surface 160-1 with an annular retaining shoulder 158-1 extending radially about the biasing surface 160-1. An annular belleville type spring 260-1 extends angularly from the biasing surface 160-1 for engaging a slider thrust ring 270-1. The annular slider thrust ring 270-1 is of an L shaped cross-section comprising a retaining ring shoulder 272-1 on the downward face of the slider thrust ring 270 and a planar idler end portion engaging surface 274-1 on the upper face of the slider thrust ring 270-1.

The axial compressive force is therefore applied through the bellville spring 260-1 and slider thrust ring 270-1 from the extension members 120-1 to the idler scroll end plate 102-1, in a fashion similar to that of the preferred embodiment. However, unlike the compression spring 170-1, the relative orbital motion of the scroll apparatus 80-1 and 100-1 is absorbed by sliding contact between the slider thrust ring 270-1 and the idler end plate 102-1.

The use of the retaining nuts 250-1 provides considerable adjustment of the compressive force supplied by the belleville spring 260-1. The belleville spring 260-1 provides more limited axial compliance than the preferred embodiment and would therefore be of more limited application.

Finally, a bore defining a lubricant metering passage 280-1 extends through the central frame portion 32-1 to interconnect the reservoir 200-1 to the lower face 210-1. In operation, the lubricant metering passage 280-1 permits a metered flow of lubricant to be forced by discharge pressure from the lubricant reservoir 200 to the suction pressure portion of the hermetic shell 22-1 in the lower hermetic shell portion 26-1. This lubricant is also entrained with the flow of lubricant at suction pressure, lubricating the scroll apparatus components as it is entrained with the fluid. The lubricant thus supplied follows a cycle then similar to the lubricant supplied through the upper main bearing 38-1. In operation, this first alternative embodiment is not substantially different from that described for the preferred embodiment, although it may be subject to different operating parameters as discussed above.

Figure 8:
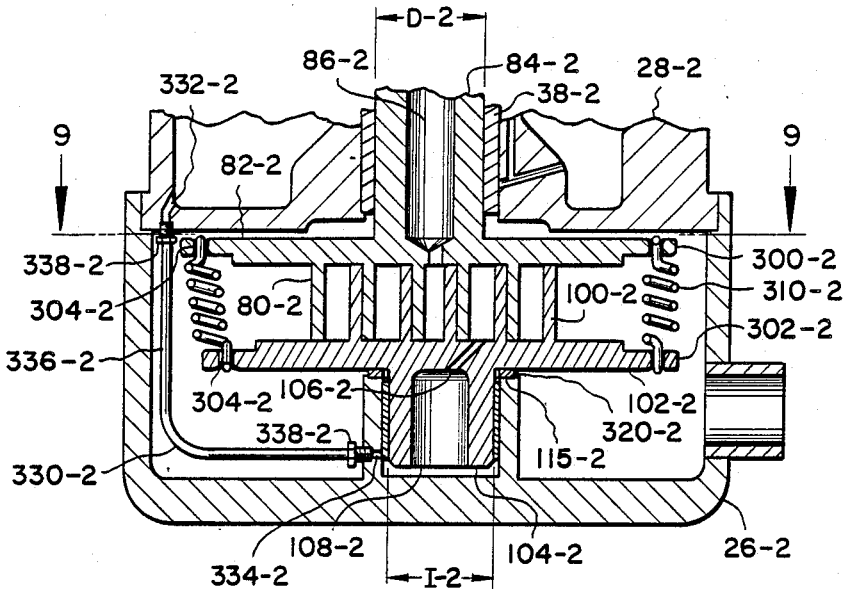
FIG. 8 shows an enlarged partial cross-sectional view of the co-rotational scroll apparatus in a second alternative embodiment.
Figure 9:
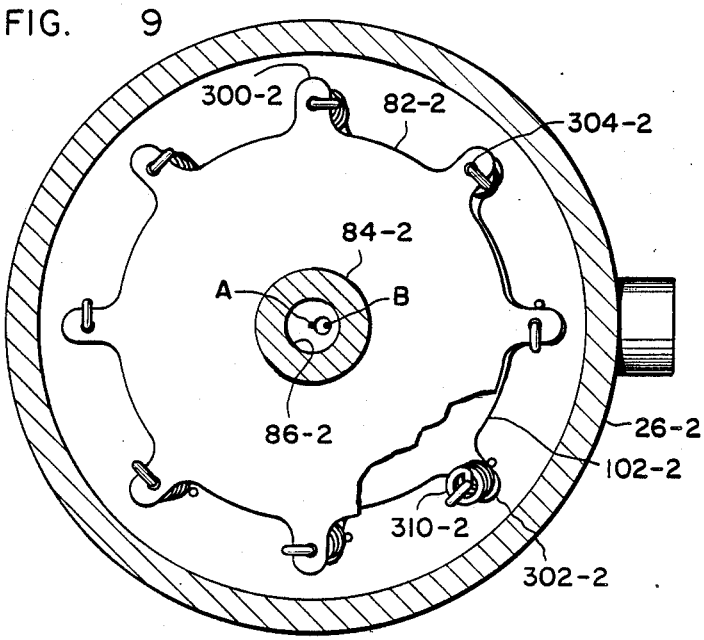
FIG. 9 is a cross-sectional view of the scroll apparatus of FIG. 8 taken along section line 9—9.

A second alternative embodiment is disclosed in FIG. 8. The driven scroll end plate 82-2 is provided with a series of radially projecting nubs 300-2 about its circumference. Identical, corresponding nubs 302-2 are provided on the idler scroll end plate 102-2. As seen in FIG. 9, eight of these nubs 300-2 are provided, however, any number of nubs 300-2 on the order of two or more are suitable. It is preferable to use at least two of the nubs 300-2, with corresponding nubs 302-2, at radially opposed positions about the scroll end plates 82-2 and 102-2 so that the scroll apparatus will be dynamically balanced during operation, and so that oscillation or nutation of the scroll member end plates 82 and 102 relative to each other will be minimized.

Figure 8A:
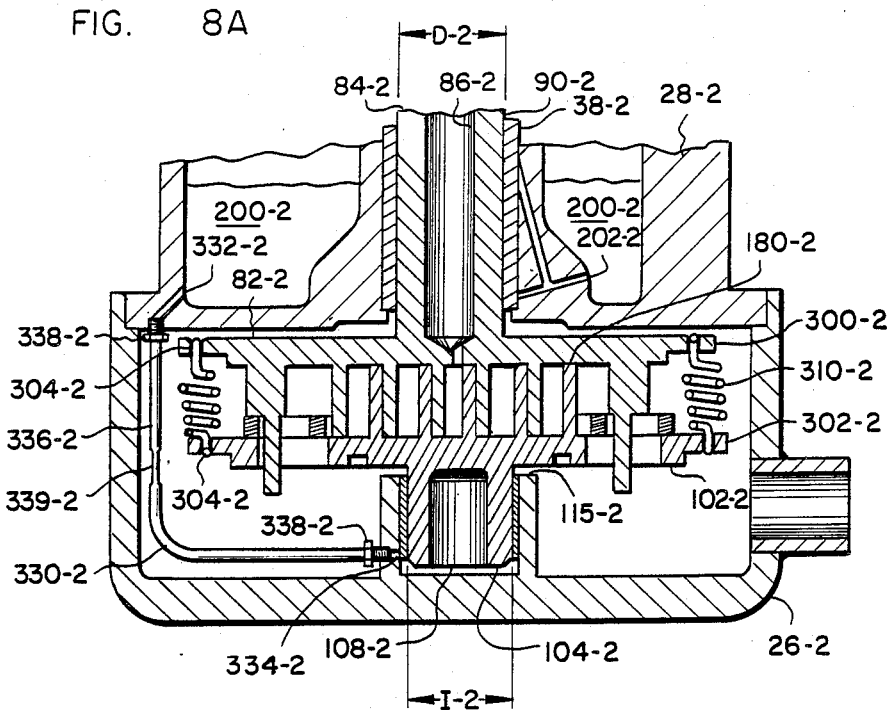
FIG. 8A shows in an enlarged cross-sectional view an alternative embodiment of the co-rotational scroll apparatus of FIG. 8.

Tension springs 310-2 extend between and directly connect each nub 300-2 on the driven scroll end palte 82-2 to the corresponding nub 302-2 on the idler scroll end plate 102-2. The tension springs 310-2 bias the respective scroll wrap end plates 82-2 and 102-2 into axial compliance. This alternative embodiment is exemplified in FIG. 8A, wherein the extension members 120-2 and the driving ring 130-2 comprise the coupling for causing simultaneous rotation of the idler scroll member 102-2 with the drive scroll member 82-2, while the tension springs 310-2 provide the means for biasing the second scroll member 102-2 to provide axial compliance between the second scroll member 102-2 and the first scroll member 82-2. These tension springs 310-2 may alternatively act as substitutes for the extension members 120 and 120-1 by causing simultaneous rotary motion of the idler scroll end plate 102-2 with the driven scroll end plate 82-2, in lieu of an Oldham Coupling as in the previous embodiments. The extension members 120 and the drive ring 130 which comprise the Oldham coupling are not shown in FIG. 8, but it is understood that this is done only to clarify the nature of the tension springs 310-2, and that the Oldham coupling members would be especially applicable to this embodiment if desired, as shown in FIG. 8A. The tension springs 310 thus may in certain embodiments permit axial compliance of the respective scroll end plates and radial changes or separation in the scroll wrap blank clearance when excessive pressure is developed between the scroll wraps 80-2 and 100-2 or when incompressable fluids enter the scroll wraps. This is simply accomplished, as the tensile force exerted by the tension springs 310 is overcome by these excessive pressures and the springs 310-2 extend to permit both radial changes and axial compliance when an Oldham Coupling or the like is not used. It would also be possible, of course, to use the tension springs 310-2 solely to provide axial compliance while using extension members and a ring as described above.

The second alternative embodiment also discloses an alternative thrust bearing for preventing excessive axial oscillation of the scroll apparatus. The lower main bearing housing 112-2 is provided with an upper shoulder 115-2 having an annular thrust bearing 320-2 disposed about the idler scroll shafts stub 104-2. This lower annular thrust bearing 320-2 may be formed of a sintered bronze material, or it may be a roller or ball type bearing and may be spring or elastomerically mounted. The construction of such a thrust bearing 320-2 is not disclosed in detail, as the construction of thrust bearings in general is believed to be generally understood by those skilled in the art.

The scroll apparatus is biased into contact with the lower thrust bearing 320-2 by providing alternately an idler shaft stub diameter I-2 smaller than the drive shaft diameter D-2 or, as shown in FIG. 8, a pressure transmission bore 106-2 which is in flow communication with an intermediate chamber of the scroll wraps 80-2 and 100-2 for providing fluid compressed to less than discharge pressure to the pressure balance chamber 108-2. The force acting upon the idler shaft stub 104-2 is thus relatively lower than the force acting upon the drive shaft 84-2 so that at least a portion of the force exerted by the weight of the scroll apparatus 80-2 and 100-2, the drive shaft 84-2 and the weight of the rotor 44-2 will be born by the thrust bearing 320-2.

Yet another feature of the second alternative embodiment is a lower bearing oil supply system 330-2. This oil supply system 330-2 is comprised of a bore 332-2 in the lower face 210-2 of the central frame portion 32-2, a bore 334-2 in the lower bearing housing 112-2, and a lubricant feed tube 336-2 connecting between the bore 332-2 and the bore 334-2. In operation, lubricant is forced by discharged pressure fluid through the bore 332-2 from the lubricant reservoir 200-2 into the lubricant feed tube 336-2 and hence to the bore in the lower bearing housing 334-2, whereupon it lubricates the lower main bearing 110-2. The lubricant feed tube is secured in the respective bores by retaining sleeves 338-2. It will be appreciated that while the flow of lubricant is enhanced where intermediate pressure fluid is used in the pressure balance chamber 108-2, the lower bearing oil supply system 330-2 would nonetheless function where discharge pressure fluid is utilized in the pressure balanced chamber 108-2, due to the slight leakage of discharge pressure fluid through the lower main bearing 110-2 to the suction pressure portion of the hermetic shell 26-2.

It will be apparent that with slight modification this oil supply system 330-2 is applicable generally to the compressor assembly 20 in any of its embodiments where a need for additional lubricant is necessary to the lower main bearing 110-2.

Figure 8B:
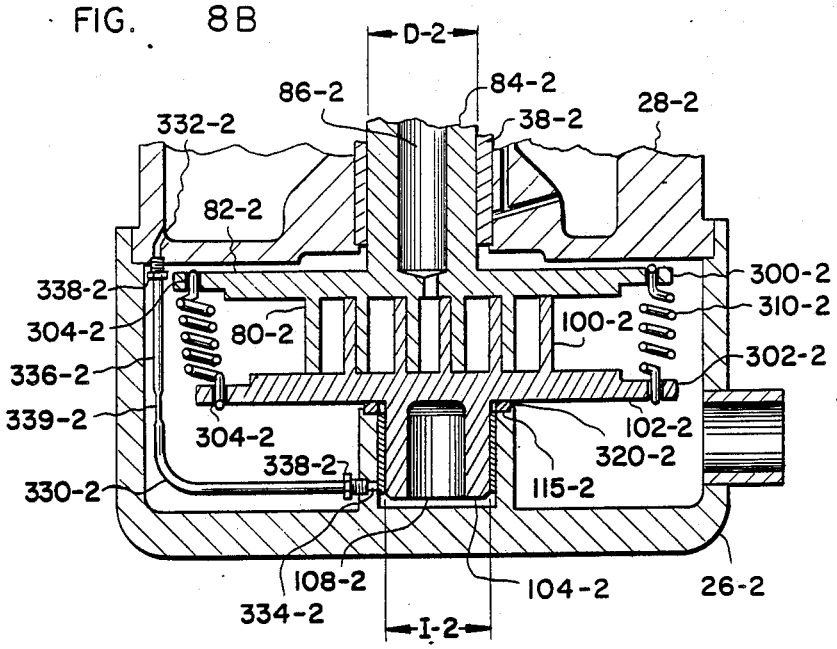
FIG. 8B shows in an enlarged cross-sectional view an alternative embodiment of the oil supply system of the co-rotational scroll apparatus.

FIG. 8B shows another combination of features of the scroll apparatus in which the scroll end plate 102-2 has no pressure transmission bore 106-2, as shown in FIG. 8, and in which the oil supply system is provided with a venturi portion 339-2 for supplying oil at an intermediate pressure to the lower bearing housing 334-2. Since the intermediate pressure includes any pressure between the discharge pressure and the suction pressure, it will be appreciated that the pressure acting upon the plan view area defined by the diameter I will bias the second scroll end plate according to the pressure supplied.

Figure 2:
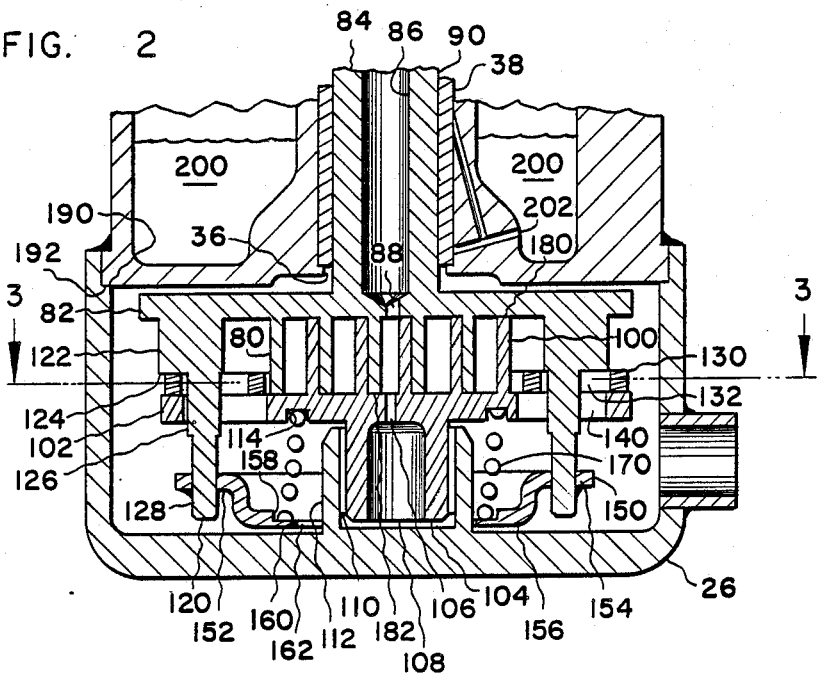
FIG. 2 shows an enlarged partial cross-sectional view of the scroll apparatus in the preferred embodiment.
Figure 3:
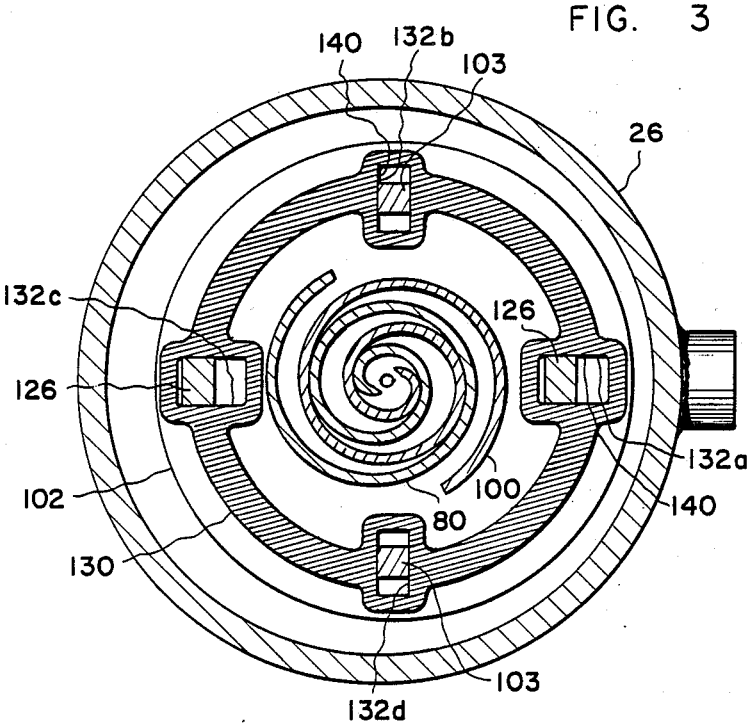
FIG. 3 shows a cross-sectional view of the scroll apparatus taken along section line 3—3 of FIG. 2.
Figure 8C:
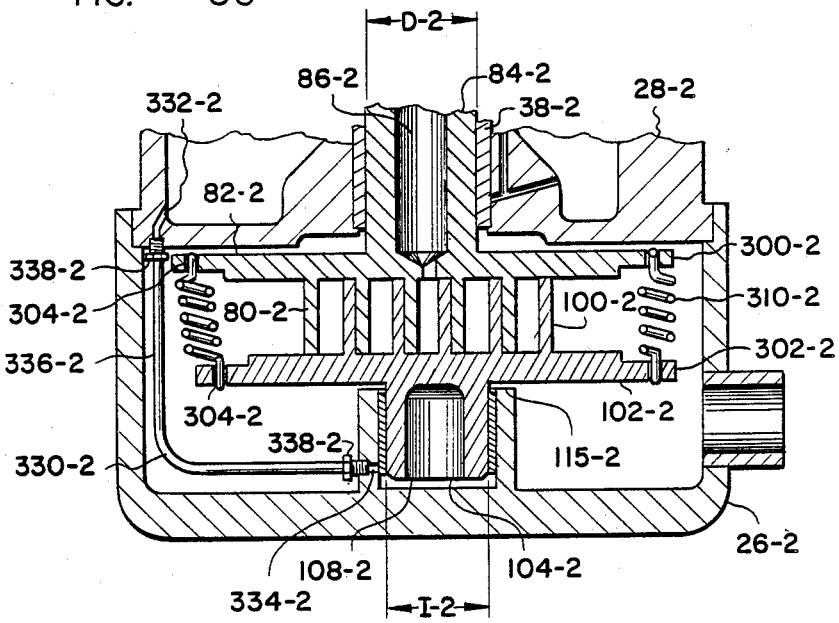
FIG. 8C shows in an enlarged cross-sectional view another embodiment of the co-rotational scroll apparatus.

Those skilled in the art will recognize that, as will be discussed in more detail subsequently, the need for the thrust bearing 320-2 may be obviated by providing discharge pressure fluid, as shown in FIGS. 1, 2, or discharge pressure lubricant as shown in FIG. 8C. Where the thrust bearing 320-2 is provided in combination with fluid at intermediate pressure acting upon the diameter I of the idler shaft stub 104-2, the weight or load carried by the thrust bearing 320-2 will increase as the intermediate pressure provided, either by fluid or lubricant, tends toward suction pressure with the result that the thrust bearing 320-2 supports the weight of the scrolls 80 and 100, the drive shaft 84 and the rotor 44, as shown in FIG. 8B. In FIG. 8B, the provided intermediate pressure is determined by the venturi portion 339-2.

It will also be appreciated that the alternative embodiment of the scroll apparatus in FIG. 8C exemplifies the alternative where the tension springs 310-2 only substitute for the extension members 120 to cause simultaneous rotary motion of the scroll end plates 102 and 82, and the alternative of providing a diameter I of the scroll shaft 104 subject the discharge pressure so that the need for a thrust bearing 320 in the lower bearing housing 112 is obviated.

Figure 10:
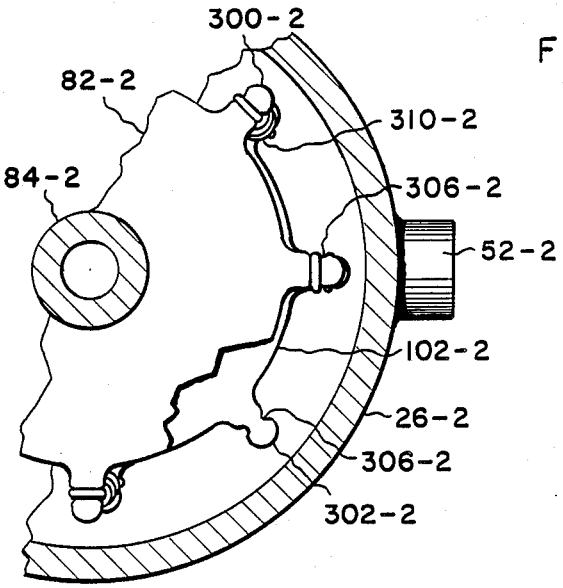
FIG. 10 shows an optional embodiment of the scroll apparatus of the second alternative in a cross-sectional view taken along section line 9—9 of FIG. 8.

FIGS. 9 and 10 disclose alternate means of connecting the tension springs 310-2 to the nubs 300-2 and 302-2. FIG. 9 shows nubs 300-2 and 302-2 provided with suitable holes 304-2 for accepting the hook-like ends of the tension springs 310-2, whereas FIG. 10 shows nubs 300-2 and 302-2 equipped with grooves 306-2 extending circumferentially across the nubs 300-2 and 302-2 for retaining the hook-like ends of the tension spring 310-2.

As in the foregoing embodiments, radial compliance is initially achieved during assembly by properly rotating the central frame portion 30-2 with respect to the lower shell portion 26-2. The adjustment of flank clearance in this second embodiment of the subject invention also serves to adjust the tension provided in tension springs 310-2 to the desired level.

A third alternative embodiment is disclosed in FIGS. 11 through 14, generally. As with the preferred and first alternative embodiments, extension members 120-3 extend through slots 132-3 in spacing ring 130-3 and through drive slots 140-3 in an idler scroll and plate 102-3. However, the third portion 128-3 is forked, providing a slot for accepting a centrifugal pivot element 342-3. The forked portion 128-3 of the extension member 120-3 and the centrifugal pivot 342-3 are provided with corresponding apertures 344-3 for accepting a pivot pin 346-3 to pivotally link the centrifugal pivot 342-3 and the extension member 120-3. The centrifugal pivot 342-3 has a center of mass $CP_m$ which is above the aperture 344-3, such that during rotation of the scroll apparatus, the center of mass $CP_m$ causes the centrifugal pivot 342-3 to pivot simultaneously upwardly and outwardly. The centrifugal pivot element 342-3 is comprised of a pivot arm 348-3 which is interfit into the sloted portion 128-3 and which contains the aperture 344-3 for the pivot pin 346-3, and a rod portion 350-3 having an upwardly directed conical recess 352-3 having a hemispheric lower end. The upwardly directed recess 352-3 contains a linking rod 354-3 extending between the hemispheric bottom of the recess 352-3 and corresponding hemispheric depression 356-3 in the idler scroll end plate 102-3. The linking rod 354-3 has ends rounded to correspond to the conical recess 352-3 and the idler end plate depressions 356-3, whereby the relative orbital movement of the scroll end plates 82-3 and 102-3 is readily absorbed during the rotation of the scroll apparatus. A top view of the centrifugal pivot 342-3 and linking rod 354-3 is shown in FIG. 13.

As in the second alternative embodiment, a thrust bearing 320-3 is provided for absorbing a portion of the axial force of the scroll apparatus resulting from the weight of the drive shaft 84-3, the rotor 44-3 and the pressure acting upon the drive shaft diameter D-3.

FIG. 14 shows the position of the centrifugal pivot 342-3 when the scroll apparatus is in the non-operating condition. In this position, the mass of the centrifugal pivot 342-3 acting through the center of mass $CP_m$ causes the centrifugal pivot 342-3 to drop away from the idler scroll end plate 102-3. FIGS. 11 and 12 show the compressor assembly 20-3 with the centrifugal pivots 342-3 in the upper, operating position.

This third embodiment of the subject invention has the advantage of providing a compressor assembly 20-3 with an unloaded axial compliance condition when not operating. As the motor 40-3 comes up to speed after actuation the centrifugal pivots 342-3 move to the operating position, causing an axial compliance load on the scroll wrap tips 180-3 and 182-3 in cooperation with the axial compliance force generated by the discharge gas pressures acting upon the drive shaft 84-3 and idler shaft stub 104-3. Thus, when the compressor assembly 20-3 is actuated, the load experienced by the motor 40-3 is initially very small and moves to full load automatically by the action of the centrifugal pivots 342-3 as the compressor is brought up to speed. Additionally, the linking rods 354-3 have a very low coefficient of friction in operation, as the rounded ends of the linking rod 354-3 cooperate with the conical recesses 352-3 and 356-3 to absorb the relative orbital motion of the scroll apparatus end plates 82-3 and 102-3. In other respects, the operation of the third alternative embodiment is similar to the operation of the preferred embodiment hereinbefore described.

Figure 15:
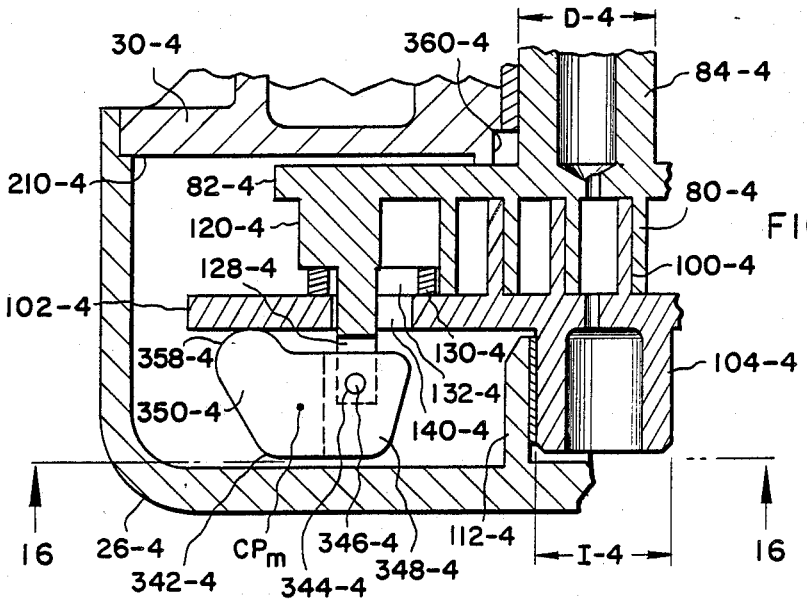
FIG. 15 shows a partial cross-sectional view of the scroll apparatus of the subject invention in a fourth alternative embodiment.
Figure 16:
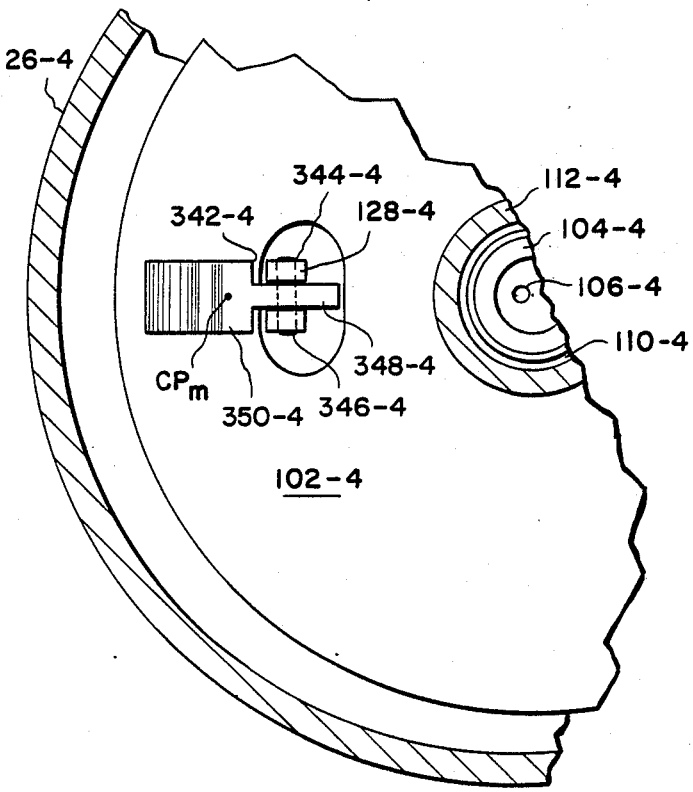
FIG. 16 shows a cross-sectional view of the alternative embodiment of FIG. 15 taken along section line 16—16 of FIG. 15.

FIGS. 15 and 16 disclose a fourth alternative embodiment which is substantially similar to that of the third alternative embodiment. In this fourth alternative embodiment, the end portion 128-4 of the extension members 120-4 are truncated and the apertures 344-4 for the pivot pin 346-4 are moved relatively upward of the center of mass $CP_m$ of the centrifugal pivot element 342-4. The centrifugal pivot 342-4 is arranged with the center of mass $CP_m$ located radially outward of and below the aperture 344-4, so that when the compressor assembly 20-4 is in operation, a rounded thrust surface 358-4 will slidingly engage the idler end plate 102-4. In this fourth embodiment, the idler scroll end plate 102-4 has an extended outer radial portion for contact with the thrust surface 358-4. Preferably, the thrust surface 358-4 will be a rounded protuberance on the upper surface of the centrifugal pivot 342-4.

An annular thrust shoulder 360-4 extends downward from the lower face 210-4 of the central frame portion 32-4 for accepting the upward thrust of the scroll apparatus. To achieve this upward thrust, the diameter I-4 is greater than the diameter D-4 in a ratio such that the pressure of discharge fluid acting upon the diameter I-4 exceeds the combination of the pressure of discharge fluid acting upon the diameter of the drive shaft D-4 and the weight of the components of the scroll apparatus in the compressor assembly 20-4. Lubrication of the thrust shoulder 360-4 is accomplished during the operation of the compressor assembly 20-4 by lubricant flowing through the upper main bearing 38-4 and then between the thrust shoulder 360-4 and the driven end plate 82-4.

In operation, this fourth alternative embodiment is substantially the same as the third alternative embodiment. However, the operation of the compressor assembly 20-4 of the fourth alternative embodiment may be slightly less efficient than that of the compressor assembly 20-3 of the third alternative embodiment due to friction between the thrust surface 358-4 and the idler scroll end plate 102-4 as the idler scroll end plate 102-4 orbits with respect to the driven scroll end plate 82-4. An advantage of the fourth alternative embodiment lies in its simplicity of construction.

Figure 18:
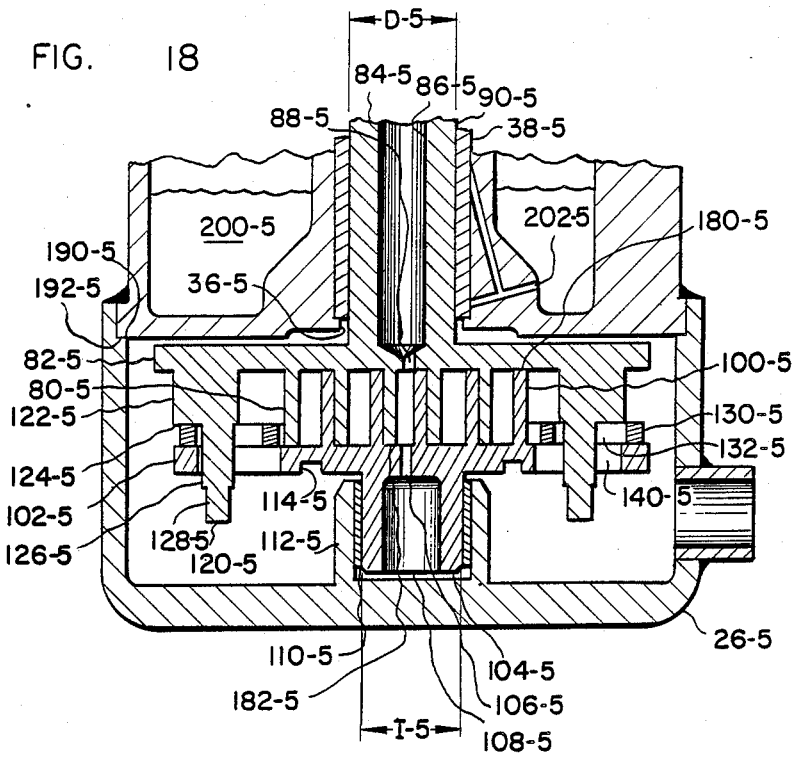
FIG. 18 shows an enlarged partial cross-sectional view of a fifth alternative embodiment of the co-rotational scroll apparatus.

A fifth alternative embodiment is disclosed in FIG. 18. In this embodiment, the extension members 120-5 and the coupling ring 130-5 drive the second scroll member end plate 102-5 simultaneously with the first scroll member end plate 82-5. As in the preferred embodiment, pressurized fluid enters the lower bearing housing 112-5 directly from the scroll wraps 80-5 through the pressure transmission bore 106-5 so that discharge pressure acts directly upon the plan view area of the idler shaft stub 104-5 to bias the second scroll member end plate 102-5 compliantly toward the first scroll member end plate 82-5.

Figure 19:
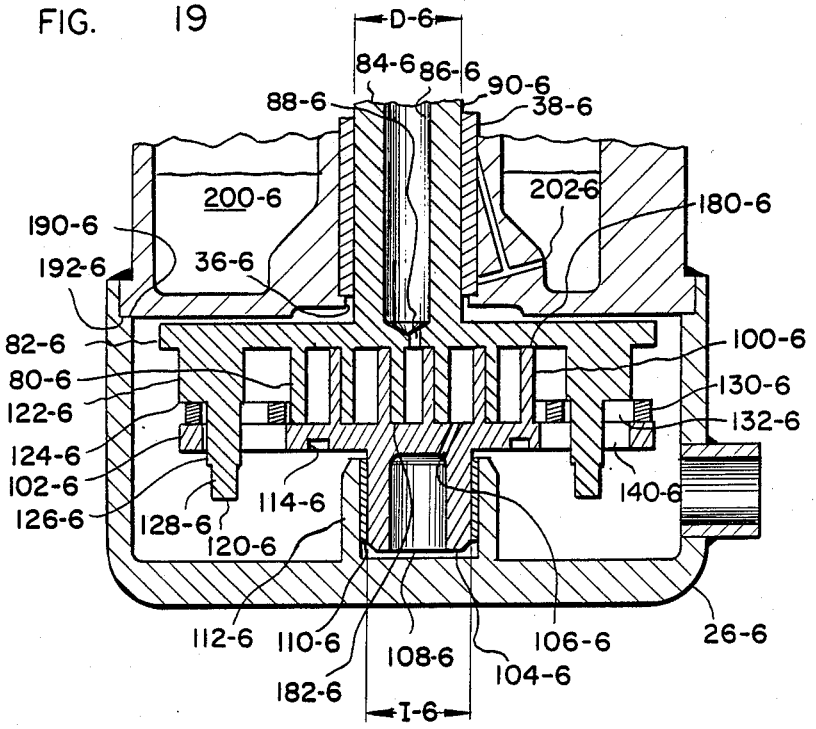
FIG. 19 shows an enlarged partial cross-sectional view of a sixth alternative embodiment of the co-rotational scroll apparatus.

A sixth alternative embodiment is disclosed in FIG. 19. This embodiment is substantially similar to the embodiment disclosed in FIG. 18 with the distinction that the pressure transmission bore 106-6 is arranged to provide communication from an intermediate pressure portion of the scroll wraps 82-6 and 102-6 so that fluid acts at an intermediate pressure upon the plan view area of the idler shaft stub 104-6, as shown also in FIG. 8.

Values of diameters I and D are not been given specifically, as it is felt that those skilled in the art would be readily capable of calculating such values for various applications of a compressor assembly 20. However, an exemplary compressor assembly 20 might be in the 5 ton to 15 ton capacity range for use in a refrigeration or air conditioning system as hereinbefore described. In such a system, the refrigerant fluid pressure experienced at the shell suction aperture 52 would typically be in the range of 0 to 100 pounds per square inch, while the fluid refrigerant discharge pressure provided by compressor assembly 20 at the shell discharge port 50 would typically be in the range of 200 to 400 pounds per square inch. The combined weight of the rotor 44 and the drive shaft 84 would be expected to be within the range of 5 to 35 pounds. The diameter I then, for example, might be 125% of the diameter D such that the net axial thrust load of the idler scroll stub 104 would support the scroll apparatus components 80 and 100, and the rotor 44 during normal operation of the compressor assembly 20. This could eliminate the requirement for a thrust bearing to absorb axial loads within the compressor assembly 20, reducing the cost of construction and maintenance of such a compressor assembly 20 while increasing the efficiency of its operation.

Alternatively, it is possible in all embodiments described to eliminate the pressure transmission bore 106 and provide pressurization of the pressure balance chamber 108 with the lubricating oil supplied through the lower bearing oil supply system 330, as the lubricating oil is supplied at discharge pressure from the reservoir 200. This would assure constant pressure lubrication of the lower annular bearing 110 and a constant balance pressure on the plan view area of the idler shaft stub 104 as defined by the diameter I. Furthermore, it would be possible to provide lubricating oil at an intermediate pressure throttled from the discharge pressure to control the balance pressure exerted on the idler shaft stub 104 by providing, for example, a throttling valve or a venturi, as exemplified in FIG. 8B, discussed above, in the lubricant feed tube 336. It is believed that specific examples of controlling the pressure or volume of the lubricating oil flow need not be detailed herein, as the method and means of controlling the pressure or volume of fluid flowing in a tube is believed to be well known to those skilled in the art.

Figure 20:
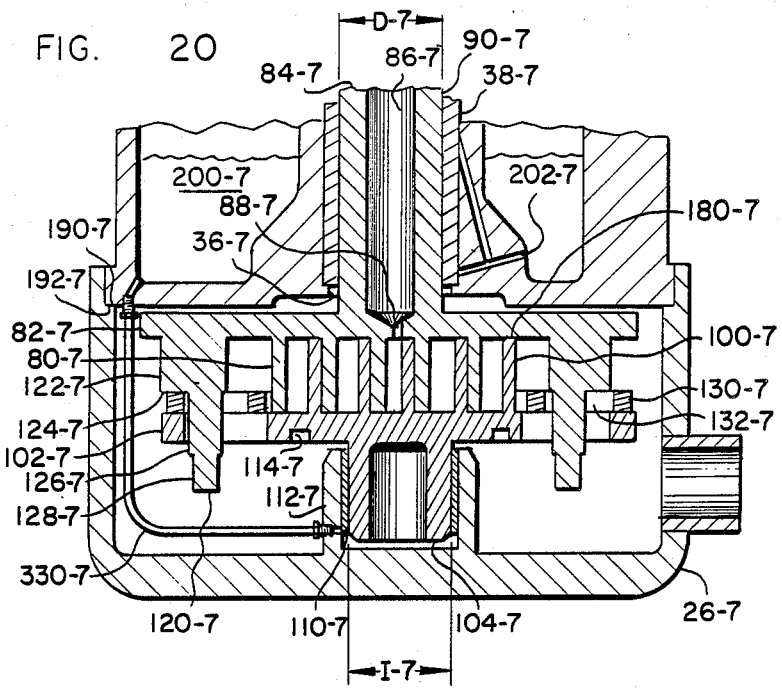
FIG. 20 shows an enlarged partial cross-sectional view of a seventh alternative embodiment of the co-rotational scroll apparatus.

In FIG. 20, a seventh alternative embodiment of the scroll apparatus is presented. In this embodiment, the extension members 120-7 and the coupling ring 130-7 drive the second scroll member end plate 102-7 simultaneously with the first scroll member end plate 82-7 as in FIGS. 18 and 19. However, the biasing force for providing the axial compliance is derived from the balance pressure exerted on the idler shaft stub 104-7 and is determined by the plan view area of the idler shaft stub 104-7 and the operating discharge pressure of the scroll apparatus. This is accomplished with the oil supply system 320-7, which supplies lubricating oil to the lower bearing housing 112-7 at discharge pressure, as discussed above.

Figure 21:
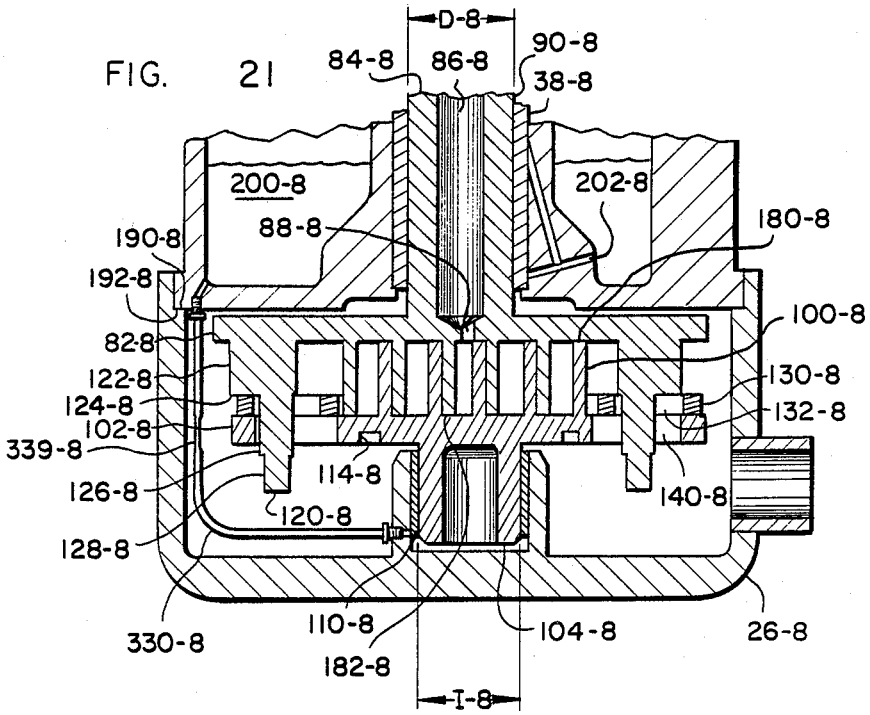
FIG. 21 shows an enlarged partial cross-sectional view of an eighth alternative embodiment of the co-rotational scroll apparatus.

In FIG. 21, an eighth alternative embodiment of the scroll apparatus is presented. This alternative embodiment is substantially similar to the alternative embodiment disclosed in FIG. 20, including the extension members 120-8 and the coupling 130-8 in conjunction with the oil supply system 320-8, with the addition of the venturi portion 339-8. As above, the oil in the lower bearing housing 112-8 is a pressurized fluid acting upon the plan view area of the idler shaft stub 104-8 to axially bias the second scroll member 102-8 compliantly toward the first scroll member 82-8. This embodiment differs from the preceeding seventh embodiment in that the lubricating oil is provided at an intermediate pressure throttled from the discharge pressure so that the balance pressure is controlled.

Also, it may be desirable to provide shaft seals at the upper main bearing 38 and the lower annular bearing 110 for additionally sealing between the suction pressure and discharge pressure portions of the scroll apparatus. In scroll apparatus utilizing the aforementioned roller or ball type bearings as the upper main bearing 38 and the lower annular bearing 110, such shaft seals would be essential, as these types of bearings would be ineffective to prevent flow of the fluid or refrigerant from the discharge pressure portion 24 to the suction pressure portion 26 of the hermetic shell 22.

The compressor assembly 20 is a substantial advancement over the prior art of scroll apparatus. The frictional losses due to axial thrust loads within the compressor can be reduced to a minimum by the pressure balancing through the diameters I and D of the drive shaft 84 and idler shaft stub 104, while at the same time the net efficiency of compression is maintained by the biasing member acting upon the respective end plates through the extension members or tension springs as shown in the alternative embodiments. Furthermore, the requirement of a radial compliance device is eliminated by the provision of non-concentric scroll axes in the hermetic shell to adjust the flank clearance between the scroll wraps during assembly. This substantially reduces the requirement for expensive and time consuming high accuracy machining processes. The need for such multiple bearings for supporting drive shafts and idler shafts, the misalignment of which typically causes unnecessary wear in the scroll wraps of co-rotating scrolls, is eliminated by the biasing means directly connecting the respective scroll wrap end plates. The annular, spring loaded thrust bearing also provides a means for preventing axial oscillations of a co-rotating scroll apparatus while simultaneously maintaining a minimum friction loss. Utilization of the pressure of discharge fluid to provide lubricant from the lubricant reservoir eliminates the need for a potentially difficult to maintain and expensive pump component within the hermetic shell, further reducing the potential requirements for maintenance in the compressor assembly 20. It will be appreciated, therefore, that the compressor assembly 20 is substantially simpler, more reliable and more efficient than previous scroll apparatus.

Modifications to the preferred and alternate embodiments of the subject invention will be apparent to those skilled in the art within the scope of the claims that follow hereinbelow.

What is claimed is:

1. A fluid apparatus comprised of:

a first scroll member having an end plate, an upstanding involute portion disposed on said end plate, and a drive shaft on said end plate, said first scroll member further including two extension members at radially opposite ends of said end plate extending generally parallel to said upstanding involute portion, said extension members having a drive key portion and a retainer portion;

a compression plate secured to said retainer portion of said extension members;

a second scroll member between said first scroll end plate and said compression plate, said second scroll member having an end plate, an upstanding involute portion disposed on said end plate for interleaving engagement with said upstanding involute portion of said first scroll member, two oppositely disposed idler drive keys, and an idler shaft on said end plate;

means for biasing said first scroll member end plate from said compression plate; and means for driveably rotating said first scroll member shaft.

2. The fluid apparatus as set forth in claim 1 wherein said second scroll member further includes means for simultaneously rotating said second scroll member with said first scroll member whereby said second scroll member is rotatably driven by said first scroll member.

3. The fluid apparatus as set forth in claim 2 wherein said means for engaging said first scroll member further includes an annular ring having two radially opposed slots, each said slot slideably accepting one of said extension members of said first scroll member.

4. The fluid apparatus as set forth in claim 3 wherein said means for engaging said first scroll member further includes two pairs of oppositely disposed slots, one said pair of slots in sliding engagement with said extension member drive key portions and the other said pair of slots in sliding engagement with said idler drive keys whereby said second scroll member is rotated simultaneously with said first scroll member.

5. The fluid apparatus as set forth in claim 4 wherein said first scroll member compression plate is generally planar and parallel to said first scroll member end plate.

6. The fluid apparatus as set forth in claim 5 wherein said means for biasing said second scroll member from said first scroll member compression plate is further comprised of a spring.

7. The fluid apparatus as set forth in claim 6 wherein said spring is a compression spring.

8. The fluid apparatus as set forth in claim 6 wherein said drive shaft includes a discharge gallery and said idler shaft includes a pressure balance chamber for axial pressure balancing of said fluid apparatus.

9. A fluid apparatus comprised of:

a hermetic shell including a high pressure portion;

a first scroll member disposed in said hermetic shell, said first scroll member having an end plate, an upstanding involute portion disposed in said end plate, and a shaft of diameter D on said end plate, said shaft having a plan view area defined by said diameter D, said plan view area exposed to high pressure in said high pressure portion of said hermetic shell for biasing said first scroll member;

a second scroll member disposed in said hermetic shell, said second scroll member having an end plate, an upstanding involute portion disposed on said end plate for interleaving engagement with said upstanding involute portion of said first scroll member, and a shaft of diameter I on said end plate, said shaft having a plan view area defined by said diameter I;

means for biasing said second scroll member end plate toward said first scroll member end plate;

means for driveably rotating said first scroll member shaft; and means for rotatably supporting said second scroll member shaft.

10. A fluid apparatus comprised of:

a hermetic shell including a high pressure portion;

a first scroll member disposed in said hermetic shell, said first scroll member having an end plate, an upstanding involute portion disposed in said end plate, and a shaft of diameter D on said end plate, said shaft having a plan view area defined by said diameter D, said plan view area exposed to high pressure in said high pressure portion of said hermetic shell;

a second scroll member disposed in said hermetic shell, said second scroll member having an end plate, an upstanding involute portion disposed on said end plate for interleaving engagement with said upstanding involute portion of said first scroll member, and a shaft of diameter I on said end plate, said shaft having a plan view area defined by said diameter I;

means for directly compliantly connecting said first and second scroll end plates for biasing said second scroll member end plate toward said first scroll member end plate;

means for driveably rotating said first scroll member shaft; and means for rotatably supporting said second scroll member shaft.

11. The fluid apparatus as set forth in claim 10 wherein said compliant connecting means is comprised of a plurality of spring members.

12. The fluid apparatus as set forth in claim 9 wherein said biasing means is further comprised of:

said first scroll member end plate having a radial outer end, said first scroll member end plate outer end having a plurality of bores defining apertures through said first scroll member end plate, said bores equidistantly spaced about said radial outer end, said bores further having axes parallel with the axis of said first scroll member shaft;

said second scroll member end plate having a radial outer end, said second scroll member end plate outer end having a plurality of bores defining apertures through said second scroll member end plate, said bores equidistantly spaced about said radial outer end, said bores further having axes parallel with the axis of said second scroll member shaft and in general alignment with the respective axes of the bores defined in said first scroll member end plate; and means disposed through said bores in said first scroll member end plate and said second scroll member end plate for compliantly connecting said first scroll member end plate and said second scroll member end plate.

13. The fluid apparatus as set forth in claim 9 wherein said diameter I is greater than said diameter D, and wherein the second scroll member shaft includes a plan view area exposed to a fluid pressure for pressure balancing of the fluid apparatus.

14. The fluid apparatus as set forth in claim 13 wherein said frame further defines an annular groove concentric with the drive shaft, an annular bearing disposed about said annular groove between said first scroll member end plate and said frame, and an annular spring between said annular bearing and said frame for biasing said annular bearing toward said first scroll member end plate.

15. The fluid apparatus as set forth in claim 9 wherein said diameter I is equal to said diameter D, and wherein the second scroll member shaft includes a plan view area exposed to a fluid pressure for pressure balancing of the fluid apparatus.

16. The fluid apparatus as set forth in claim 9 wherein said diameter I is less than said diameter D, and wherein the second scroll member shaft includes a plan view area exposed to a fluid pressure for pressure balancing of the fluid apparatus.

17. The fluid apparatus as set forth in claim 16 wherein said means for rotationally supporting said second scroll member shaft is further comprised of a housing having an annular bearing therein and a shoulder having an annular thrust bearing thereon in sliding engagement with said second scroll member end plate.

18. A fluid apparatus comprised of:

a first scroll member having an end plate, an upstanding involute portion disposed on said end plate, and a drive shaft on said end plate, said drive shaft having a diameter D with a plan view area exposed to fluid at a pressure for pressure balancing said first scroll member, said first scroll member further including two extension members at radially opposite ends of said end plate extending generally parallel to said upstanding involute portion, said extension members having a drive key portion;

a second scroll member having an end plate, an upstanding involute portion disposed on said end plate for interleaving engagement with said upstanding involute portion of said first scroll member, two oppositely disposed idler drive keys, and an idler shaft on said end plate said idler shaft having a diameter I;

means for biasing said second scroll member end plate;

means for driveably rotating said first scroll member shaft; and means for simultaneously rotating said second scroll member.

19. The fluid apparatus as set forth in claim 18 wherein said fluid apparatus further includes a hermetic shell having a first portion with a first axis of generation $C_1$ and a second portion with a second axis of generation $C_2$.

20. A fluid apparatus comprised of:

a hermetic shell having a first portion with a first axis of generation $C_1$ and a second portion with a second axis of generation $C_2$;

a first scroll member having an end plate, an upstanding involute portion disposed on said end plate, and a drive shaft on said end plate, said drive shaft having a diameter D, said first scroll member further including two extension members at radially opposite ends of said end plate extending generally parallel to said upstanding involute portion, said extension members having a drive key portion, said first scroll member shaft having a parallel, non-concentric axis of rotation A with respect to said first axis of generation $C_1$;

a second scroll member having an end plate, an upstanding involute portion disposed of end plate for interleaving engagement with said upstanding involute portion of said first scroll member, two oppositely disposed idler drive keys, an idler shaft on said end plate said idler shaft having a diameter I, said second scroll member shaft further having a parallel, non-concentric axis of rotation B with respect to said second axis of rotation $C_2$;

means for biasing said second scroll member end plate;

means for rotatably supporting said second scroll member shaft disposed in said second portion of said hermetic shell;

means for driveably rotating said first scroll member shaft disposed in the first portion of said hermetic shell; and means for simultaneously rotating said second scroll member.

21. The fluid apparatus as set forth in claim 20 wherein the first engagement surface is positionably fixable to the second engagement surface about an axis C equal to the first axis of generation $C_1$ and equal to the second axis of generation $C_2$.

22. The fluid apparatus as set forth in claim 21 wherein the axis of rotation A of said first scroll member shaft is offset from said first axis of generation $C_1$ and the axis of rotation B of said second scroll member shaft is offset from said second axis of generation $C_2$ and is further offset from said axis of rotation A.

23. The fluid apparatus as set forth in claim 22 wherein said biasing means is further comprised of a centrifugal pivot member pivotally mounted on each respective said extension member, each said centrifugal pivot member having a center of mass disposed for causing said centrifugal pivot member to pivot into engagement with said second scroll member end plate when said scrolls are rotated.

24. The fluid apparatus as set forth in claim 23 wherein said first portion of said hermetic shell is positionally fixed to said second portion of said hermetic shell during assembly of said hermetic shell.

25. The fluid apparatus as set forth in claim 24 wherein said fluid apparatus is further comprised of a frame in said hermetic shell, said frame dividing said hermetic shell into a suction pressure portion and a discharge pressure portion.

26. The fluid apparatus as set forth in claim 25 wherein the frame further includes a lubricant reservoir.

27. The fluid apparatus as set forth in claim 26 wherein said means for driveably rotating said first scroll member shaft further includes a motor.

28. The fluid apparatus as set forth in claim 27 wherein the frame is further operative to support the motor within said hermetic shell.

29. The fluid apparatus asset forth in claim 28 wherein the frame further includes an upper main bearing for bearing rotational motion of said drive shaft.

30. The fluid apparatus as set forth in claim 29 wherein the frame further includes a lubricant passage from said lubricant reservoir to said bearing.

31. The fluid apparatus as set forth in claim 30 wherein the frame further includes a lubricant metering aperture for metering flow communication of a lubricant from said lubricant reservoir to said suction pressure portion wherein said lubricant is entrained with the fluid.

32. The fluid apparatus as set forth in claim 31 wherein said motor includes a stator and a rotor defining an annular space in which the lubricant is disentrained from said fluid and through which the disentrained lubricant flows to said reservoir.

33. The fluid apparatus as set forth in claim 18 wherein said first scroll member end plate and said first scroll member shaft further include a discharge gallery.

34. The fluid apparattus as set forth in claim 18 wherein said diameter I is greater than said diameter D, and wherein the second scroll member shaft includes a plan view area exposed to a fluid pressure for pressure balancing of the fluid apparatus.

35. The fluid apparatus as set forth in claim 34 wherein said frame further defines an annular groove concentric with the drive shaft, an annular bearing disposed about said annular groove between said first scroll member end plate and said frame, and an annular spring between said annular bearing and said frame for biasing said annular bearing toward said first scroll member end plate.

36. The fluid apparatus as set forth in claim 9 wherein said diameter I is equal to said diameter D, and wherein the second scroll member shaft includes a plan view area exposed to a fluid pressure for pressure balancing of the fluid apparatus.

37. The fluid apparatus as set forth in claim 9 wherein said diameter I is less than said diameter D, and wherein the second scroll member shaft includes a plan view area exposed to a fluid pressure for pressure balancing of the fluid apparatus.

38. The fluid apparatus as set forth in claim 37 wherein said means for rotationally supporting said second scroll member shaft is further comprised of a housing having an annular bearing therein and a shoulder having an annular thrust bearing thereon in sliding engagement with said second scroll member end plate.

39. A fluid apparatus comprised of:

a hermetic shell including a first portion with a first axis of generation $C_1$ and a second portion with a second axis of generation $C_2$;

a first scroll member disposed in said hermetic shell, said first scroll member having an end plate, an upstanding involute portion disposed on said end plate, said end plate further including two radially opposed extension members, said extension members extending generally parallel to said upstanding involute portion, and a shaft of said end plate, said shaft having a parallel axis of rotation A with said first axis of generation $C_1$ and further having an axial bore defining a discharge aperture;

a compression plate secured to said extension members;

a second scroll member disposed in said hermetic shell between said first scroll end plate and said compression plate, said second scroll member having an end plate, an upstanding involute portion disposed on said end plate for interleaving engagement with said upstanding involute portion of said first scroll member, said end plate further including a shaft having a parallel axis of rotation B with said second axis of generation $C_2$, said shaft of said second scroll member further including an axial bore;

means for biasing said second scroll member end plate from said first scroll member compression plate;

a motor for driveably rotating said first scroll member shaft;

means for adjustment of flank clearance between said involute portion of said first scroll member and said involute portion of said second scroll member; and means for rotatably supporting said second scroll member shaft.

40. The fluid apparatus as set forth in claim 39 wherein said means for rotatably supporting said second scroll member shaft is further comprised of an annular housing in said second portion of the hermetic shell, said annular housing including an annular bearing rotatably connecting said second scroll member shaft.

41. The fluid apparatus as set forth in claim 40 wherein said first scroll member compression plate is generally planar and parallel with respect to said first scroll member end plate.

42. The fluid apparatus as set forth in claim 41 wherein said means for biasing said second scroll member from said first scroll member compression plate is further comprised of a compression spring.

43. The fluid apparatus as set forth in claim 42 wherein an annular sliding thrust ring engages said spring and said second scroll end plate.

44. A fluid compressor for compressing a fluid from a section pressure to a relatively higer discharge pressure, said fluid compressor comprised of:

a hermetic shell including a first portion with a cylindrical lip generated about a first axis of generation $C_1$ and a second portion with a cylindrical shoulder generated about a second axis of generation $C_2$, said hermetic shell having a common axis C including the respective axes of generation $C_1$ and $C_2$, said first portion and said second portion being positionable about said common axis C during assembly of said hermetic shell;

a first scroll member disposed in said hermetic shell, said first scroll member having an end plate, an upstanding involute wrap disposed on said end plate, said end plate further including two extension members extending generally parallel to said upstanding involute portion, and a drive shaft of diameter D on said end plate, said drive shaft having an axis of rotation A parallel to said first axis of generation $C_1$ and further having an axial bore defining a discharge gallery;

a compression plate secured to said extension members;

a second scroll member disposed in said hermetic shell between said first scroll end plate and said compression plate, said second scroll member having an end plate with an upstanding involute wrap of said first scroll member, two radially opposed idler drive keys, said end plate also including two clearance slots, and a pressure transmission bore, said end plate further including an idler shaft of diameter I having an axis of rotation B parallel to said axis of generation C2 and to the axis of rotation A of said drive shaft;

an annular ring having four slots for engaging said extension members and said idler drive keys;

a spring biasingly connecting said second scroll member end plate and said first scroll member compression plate;

a motor in said first portion of said hermetic shell, said motor connected to said drive shaft; and an annular lower bearing housing rotatably supporting said idler shaft.

45. The compressor as set forth in claim 44 wherein said lower bearing housing further includes a lower bearing for engaging said second scroll member shaft.

46. The compressor as set forth in claim 45 wherein said first portion of said hermetic shell contains fluid at said discharge pressure and said second portion of said hermetic shell contains fluid at said suction pressure.

47. The compressor as set forth in claim 46 wherein said first scroll member and said second scroll member are disposed in said second portion of said hermetic shell.

48. The compressor as set forth in claim 47 wherein said hermetic shell further includes a frame for separating said first and second portions of said hermetic shell, said frame further defining a reservoir depression in said first portion of said hermetic shell for receiving lubricant.

49. The compressor as set forth in claim 48 wherein said frame further includes a metering passage connecting between said reservoir and said second portion of said hermetic shell for metering lubricant from said first portion to said second portion of the hermetic shell.

50. The compressor as set forth in claim 48 wherein said frame further defines a bearing having a bearing therein for engaging said drive shaft.

51. The compressor as set forth in claim 50 wherein said frame further includes bore defining a lubricant passage connecting said reservoir and said bearing aperture for providing a metered amount of lubricant to said bearing means.

52. The compressor as set forth in claim 48 wherein said frame is further operative to support said motor.

53. The compressor as set forth in claim 45 wherein said bearing, said lower bearing housing and said idler shaft define a pressure balance chamber.

54. The compressor as set forth in claim 53 wherein said drive shaft has a plan view area determined by diameter D, said drive shaft exposed to discharge pressure fluid.

55. The compressor as set forth in claim 54 wherein said idler shaft has a plan view area determined by the diameter I, said idler shaft exposed to discharge pressure fluid in said pressure balance chamber.

56. The compressor as set forth in claim 54 wherein said idler shaft has a plan view area determined by the diameter I, said idler shaft exposed to an intermediate pressure fluid in a pressure balance chamber.

57. The compressor as set forth in claim 54 wherein said idler shaft has a plan view area determined by the diameter I, said idler shaft exposed to lubricant at discharge pressure.

58. The compressor as set forth in claim 54 wherein said shaft has a plan view area determined by the diameter I, said idler shaft exposed to lubricant at an intermediate pressure.

59. The compressor as set forth in claim 54 wherein said first scroll member compression plate is generally planar and parallel with respect to said first scroll member end plate.

60. The compressor as set forth in claim 59 wherein said compression plate includes a central aperture radially disposed about said lower bearing housing.

61. The compressor as set forth in claim 44 wherein said hermetic shell further includes means for adjusting flank clearance between said first involute wrap and said second involute wrap comprised of a first offset of the axis of rotation A of said first scroll member shaft from said first axis of generation $C_1$, and a second offset of the axis of rotation B of said second scroll member shaft from said second axis of generation $C_2$, whereby said first and second portions of said hermetic shell are positionable during assembly to define a maximum orbit radius between said first scroll member and said second scroll member comprised of the sum of said offsets and to define a minimum orbit radius between said first scroll member and said second scroll member comprised of the difference of said offsets.

62. The compressor as set forth in claim 61 wherein said first offset is smaller than said second offset.

63. The compressor as set forth in claim 61 wherein said second offset is smaller than said first offset.

64. The compressor as set forth in claim 44 wherein said diameter I is equal to said diameter D.

65. The compressor as set forth in claim 64 wherein said means for rotationally supporting said second scroll member shaft is further comprised of a housing having an annular bearing therein and a shoulder having an annular thrust bearing thereon in sliding engagement with said second scroll member end plate.

66. The compressor as set forth in claim 44 wherein said diameter I is less than said diameter D.

67. The compressor as set forth in claim 44 wherein said diameter I is greater than said diameter D.

68. The compressor as set forth in claim 67 wherein said means for rotatably supporting said second scroll member shaft is further comprised of an annular groove in said second portion of the hermetic shell, said annular groove further including an annular bearing rotatably connecting said second scroll member shaft.

69. A scroll compressor apparatus for compressing a fluid from a suction pressure to a relatively higher discharge pressure, said scroll compressor comprised of:

a drive scroll member having an end plate, and upstanding involute wrap disposed on said end plate, said end plate further including two radially opposed extension members extending generally parallel to said upstanding first involute portion, each said extension member further having a drive key portion and a retainer portion, and a drive shaft of diameter D on said end plate, said drive shaft having an axis of rotation A and further having an axial bore defining a discharge gallery;

a compression plate secured to and extending between said retainer portions of said extension members;

an idler scroll member between said drive scroll end plate and said compression plate, said idler scroll member having an end plate, an upstanding second involute wrap disposed on said end plate for interleaving engagement with said upstanding involute wrap of said drive scroll member, said end plate also including two radially opposed idler drive keys radially outside of said involute wrap, said end plate further including an idler shaft of diameter I having an axis of rotation B;

a spring biasingly connecting said idler scroll member end plate and said compression plate;

a hermetic shell including a first, discharge pressure portion with a cylindrical lip generated about a first axis of generation $C_1$ and a second, suction pressure portion with cylindrical shoulder generated about a second axis of generation $C_2$, said suction pressure portion further having said drive and idler scroll members disposed therein, said hermetic shell having a common axis C including the respective axes of generation $C_1$ and $C_2$, said hermetic shell further including means for adjusting flank clearance between said first involute wrap and said second involute wrap comprised of a first offset of the axis of rotation A of said first scroll member shaft from said first axis of generation $C_1$, and a second substantially larger offset of the axis of rotation B of said second scroll member shaft from said second axis of generation $C_2$, whereby said first and second portions of said hermetic shell are positionable during assembly of said hermetic shell to define a maximum orbit between said first scroll member and said second scroll member comprised of the sum of said offsets and to define a minimum orbit between said drive scroll member and said idler scroll member comprised of the difference of said offsets, said hermetic shell further including a central frame portion defining a lubricant reservoir in said discharge pressure portion and an aperture for accepting said drive shaft, said central frame portion having a bore defining a lubricant passage;

a motor disposed in said discharge pressure portion of said hermetic shell, said motor having a rotor and a stator defining an annular space therebetween for the passage of lubricant, said rotor connected to said drive shaft; and an annular lower bearing housing in said suction pressure portion, said lower bearing housing having a bearing therein, said bearing rotatably supporting said idler shaft, said lower bearing housing and said idler shaft further cooperating to define a pressure balance chamber.

70. The scroll compressor as set forth in claim 69 wherein said idler scroll end plate further includes a pressure transmission bore through said idler scroll end plate for flow communication from said scroll wraps to said pressure balance chamber.

71. The scroll compressor as set forth in claim 69 wherein said scroll compressor further includes means for supplying discharge pressure lubricant to said pressure balance chamber.

72. The scroll compressor as set forth in claim 69 wherein said scroll compressor further includes means for supplying intermediate pressure lubricant to said pressure balance chamber.

73. The scroll compressor as set forth in claim 69 wherein said first offset is smaller than said second offset.

74. The scroll compressor as set forth in claim 69 wherein said second offset is smaller than said first offset.

75. A refrigeration system for circulating refrigerant in closed loop connection comprised of:

a condenser for condensing refrigerant to liquid form;

an expansion valve for receiving liquid refrigerant from said condenser and expanding the refrigerant;

an evaporator for receiving liquid refrigerant from said expansion valve and evaporating the refrigerant; and a compressor for receiving expanded refrigerant from said evaporator and compressing the refrigerant, said compressor comprised of:

a hermetic shell including a first portion with a cylindrical lip generated about a first axis of generation $C_1$ and a second portion with cylindrical shoulder generated a second axis of generation $C_2$, said hermetic shell having a common axis C including the respective axes of generation $C_1$ and $C_2$, said first portion and said second portion being positionable about said common axis C during assembly of said hermetic shell;

a first scroll member disposed in said hermetic shell, said first scroll member having an end plate, an upstanding involute wrap disposed on said end plate, said end plate further including two extension members extending generally parallel to said upstanding involute portion, and a drive shaft of diameter D on said end plate, said drive shaft having an axis of rotation A parallel to said first axis of generation $C_1$ and further having an axial bore defining a discharge gallery;

a compression plate secured to said extension members;

a second scroll member disposed in said hermetic shell between said first scroll end plate and said first scroll compression plate, said second scroll member having an end plate, an upstanding involute wrap disposed on said end plate for interleaving engagement with said upstanding involute wrap of said first scroll member, two radially opposed idler drive keys, said end plate also including two clearance slots, and a pressure transmission bore, said end plate further including an idler shaft of diameter I having an axis of rotation B parallel to said second axis of generation $C_2$ and the axis of rotation A of said drive shaft;

an annular ring having four slots for engaging said extension members and said idler drive keys;

a spring biasingly connecting said second scroll member end plate and said first scroll member compression plate;

a motor in said first portion of said hermetic shell, said motor connected to said drive shaft; and an annular lower bearing housing rotatably supporting said idler shaft.

76. The refrigreation system as set forth in claim 75 wherein said first portion of said hermetic shell contains refrigerant at said discharge pressure and said second portion of said hermetic shell contains refrigerant at said suction pressure.

77. The refrigeration system as set forth in claim 76 wherein said first scroll member and said second scroll member are disposed in said second portion of said hermetic shell.

78. The refrigeration system as set forth in claim 77 wherein said hermetic shell further includes a frame for separating said first and second portions of said hermetic shell, said frame further defining a reservoir depression in said first portion of said hermetic shell for receiving lubricant.

79. The refrigeration system as set forth in claim 78 wherein said frame further defines a bearing aperture having therein bearing means for engaging said drive shaft.

80. The refrigeration system as set forth in claim 79 wherein said frame further includes bore defining a lubricant passage connecting said reservoir passage and said bearing aperture for providing a metered amount of lubricant to said bearing means.

81. The refrigeration system as set forth in claim 79 wherein said frame is further operative to support said motor.

82. The refrigeration system as set forth in claim 78 wherein said frame further includes a metering passage connecting between said reservoir and said second portion of said hermetic shell for metering lubricant from said first portion to said second portion of the hermetic shell.

83. The refrigeration system as set forth in claim 75 wherein said lower bearing housing further includes a lower bearing for engaging said second scroll member shaft.

84. The refrigeration system as set forth in claim 83 wherein said sleeve, said lower bearing housing and said idler shaft define a pressure balance chamber.

85. The refrigeration system as set forth in claim 84 wherein said drive shaft has a plan view area determined by diameter D, said drive shaft exposed to discharge pressure refrigerant.

86. The refrigeration system as set forth in claim 84 wherein said idler shaft has a plan view area determined by the diameter I, said idler shaft exposed to refrigerant at discharge pressure in said pressure balance chamber.

87. The refrigeration system as set forth in claim 84 wherein said idle shaft has a plan view area determined by the diameter I, said idler shaft exposed to refrigerant at an intermediate pressure in said pressure balance chamber.

88. The refrigeration system as set forth in claim 77 wherein said idler shaft has a plan view area determined by the diameter I, said idler shaft exposed to discharge pressure lubricant in said pressure balance chamber.

89. The refrigertaion system as set forth in claim 88 wherein said idler shaft has a plan view area determined by the diameter I, said idler shaft exposed to lubricant at an intermediate pressure in said pressure balance chamber.

90. The refrigeration system as set forth in claim 75 wherein said first scroll member compression plate is generally planar and parallel with respect to said first scroll member end plate.

91. The refrigeration system as set forth in claim 90 wherein said compression plate includes a central aperture radially disposed about said lower bearing housing.

92. The compressor as set forth in claim 75 wherein said hermetic shell further includes means for adjusting flank clearance between said first involute wrap and said second involute wrap comprised of a first offset of the axis of rotation A of said first scroll member shaft from said first axis of generation $C_1$ and a second offset of the axis of rotation B of said second scroll member shaft from said second axis of generation $C_2$, whereby said first and second portions of said hemetic shell are positionable during assembly to define a maximum orbit radius between said first scroll member and said second scroll member comprised of the sum of said offsets and to define a minimum orbit radius between said forst scroll member and said second scroll member comprised of the difference of said offsets.

93. The compressor as set forth in claim 92 wherein said first offset is smaller than said second offset.

94. The compressor as set forth in claim 92 wherein said second offset is smaller than said first offset.

95. The refrigeration system as set forth in claim 75 wherein said diameter I is equal to said diameter D.

96. The refrigeration system as set forth in claim 95 wherein said means for rotationally supporting said second scroll member shaft is further comprised of a housing having a sleeve bearing therein and a shoulder having an annular thrust bearing thereon in sliding engagement with said second scroll member end plate.

97. The refrigeration system as set forth in claim 75 wherein said diameter I is less than said diameter D.

98. The refrigeration system as set forth in claim 75 wherein said diameter I is greater than said diameter D.

99. The fluid apparatus as set forth in claim 4 wherein said fluid apparatus further includes means for biasing said second scroll member end plate toward said first scroll member end plate.

100. The fluid apparatus as set forth in claim 99 wherein said means for biasing said second scroll member end plate is further comprised of an idler shaft having a diameter I having a plan view area exposed to a fluid at a pressure, and a drive shaft having a diameter D.

101. The fluid apparatus as set forth in claim 100 wherein said diameter I is greater than said diameter D, and wherein the plan view area of the second scroll member shaft is exposed to a fluid pressure for pressure balancing of the fluid apparatus.

102. The fluid apparatus as set forth in claim 101 wherein said second scroll member end plate further includes a pressure transmission bore, said pressure transmission bore providing discharge pressure fluid for acting upon the plan view area of said second scroll member shaft.

103. The fluid apparatus as set forth in claim 101 wherein said second scroll member shaft further includes a pressure transmission bore, said pressure transmission bore providing fluid at an intermediate pressure for acting upon the plan view area of said second scroll member shaft.

104. The fluid apparatus as set forth in claim 101 wherein said fluid apparatus further includes means for providing lubricant at discharge pressure for acting upon the plan view area of said second scroll member shaft.

105. The fluid apparatus as set forth in claim 101 wherein said fluid apparatus further includes means for providing lubricant at an intermediate pressure for acting upon the plan view are of said second scroll member shaft.

106. The fluid apparatus as set forth in claim 100 wherein said diameter I is equal to said diameter D, and wherein the plan view area of the second scroll member shaft is exposed to a fluid pressure for pressure balancing of the fluid apparatus.

107. The fluid apparatus as set forth in claim 106 wherein said second scroll member end plate further includes a pressure transmission bore, said pressure transmission bore providing discharge pressure fluid for acting upon the plan view area of said second scroll member shaft.

108. The fluid apparatus as set forth in claim 106 wherein said second scroll member shaft further includes a pressure transmission bore, said pressure transmission bore providing fluid at an intermediate pressure for acting upon the plan view area of said second scroll member shaft.

109. The fluid apparatus as set forth in claim 106 wherein said fluid apparatus further includes means for providing lubricant at discharge pressure for acting upon the plan view area of said second scroll member shaft.

110. The fluid apparatus as set forth in claim 106 wherein said fluid apparatus further includes means for providing lubricant at an intermediate pressure for acting upon the plan view area of said second scroll member shaft.

111. The fluid apparatus as set forth in claim 100 wherein said diameter I is less than said diameter D, and wherein the plan view area of the second scroll member shaft is exposed to a fluid pressure for pressure balancing of the fluid apparatus.

112. The fluid apparatus as set forth in claim 111 wherein said second scroll member end plate further includes a pressure transmission bore, said pressure transmission bore providing discharge pressure fluid for acting upon the plan view area of said second scroll member shaft.

113. The fluid apparatus as set forth in claim 111 wherein said second scroll member shaft further includes a pressure transmission bore, said pressure transmission bore providing fluid at an intermediate pressure for acting upon the plan view area of said second scroll member shaft.

114. The fluid apparatus as set forth in claim 111 wherein said fluid apparatus further includes means for providing lubricant at discharge pressure for acting upon the plan view area of said second scroll member shaft.

115. The fluid apparatus as set forth in claim 111 wherein said fluid apparatus further includes means for providing lubricant at an intermediate pressure for acting upon the plan view area of said second scroll member shaft.

116. The fluid apparatus as set forth in claim 13 wherein said second scroll member end plate further includes a pressure transmission bore, said pressure transmission bore providing discharge pressure fluid for acting upon the plan view area of said second scroll member shaft.

117. The fluid apparatus as set forth in claim 13 wherein said second scroll member shaft further includes a pressure transmission bore, said pressure transmission bore providing fluid at an intermediate pressure for acting upon the plan view area of said second scroll member shaft.

118. The fluid apparatus as set forth in claim 13 wherein said fluid apparatus further includes means for providing lubricant at discharge pressure for acting upon the plan view area of said second scroll member shaft.

119. The fluid apparatus as set forth in claim 13 wherein said fluid apparatus further includes means for providing lubricant at an intermediate pressure for acting upon the plan view area of said second scroll member shaft.

120. The fluid apparatus as set forth in claim 15 wherein said second scroll member end plate further includes a pressure transmission bore, said pressure transmission bore providing discharge pressure fluid for acting upon the plan view area of said second scroll member shaft.

121. The fluid apparatus as set forth in claim 15 wherein said second scroll member shaft further includes a pressure transmission bore, said pressure transmission bore providing fluid at an intermediate pressure for acting upon the plan view area of said second scroll member shaft.

122. The fluid apparatus as set forth in claim 15 wherein said fluid apparatus further includes means for providing lubricant at discharge pressure for acting upon the plan view area of said second scroll member shaft.

123. The fluid apparatus as set forth in claim 15 wherein the fluid apparatus further includes means for providing lubricant at an intermediate pressure for acting upon the plan view area of said second scroll member shaft.

124. The fluid apparatus as set forth in claim 16 wherein said second scroll member end plate further includes a pressure transmission bore, said pressure transmission bore providing discharge pressure fluid for acting upon the plan view area of said second scroll member shaft.

125. The fluid apparatus as set forth in claim 16 wherein said second scroll member shaft further includes a pressure transmission bore, said pressure transmission bore providing fluid at an intermediate pressure for acting upon the plan view area of said second scroll member shaft.

126. The fluid apparatus as set forth in claim 16 wherein said fluid apparatus further includes means for providing lubricant at discharge pressure for acting upon the plan view area of said second scroll member shaft.

127. The fluid apparatus as set forth in claim 16 wherein said fluid apparatus further includes means for providing lubricant at an intermediate pressure for acting upon the plan view area of said second scroll member shaft.

128. The fluid apparatus as set forth in claim 10 wherein said diameter I is greater than said diameter D, and wherein the plan view area of the second scroll member shaft is exposed to a fluid pressure for pressure balancing of the fluid apparatus.

129. The fluid apparatus as set forth in claim 128 wherein said second scroll member end plate further includes a pressure transmission bore, said pressure transmission bore providing discharge pressure fluid for acting upon the plan view area of said second scroll member shaft.

130. The fluid apparatus as set forth in claim 128 wherein said second scroll member shaft further includes a pressure transmission bore, said pressure transmission bore providing fluid at an intermediate pressure for acting upon the plan view area of said second scroll member shaft.

131. The fluid apparatus as set forth in claim 128 wherein said fluid apparatus further includes means for providing lubricant at discharge pressure for acting upon plan view area of said second scroll member shaft.

132. The fluid apparatus as set forth in claim 128 wherein said fluid apparatus further includes means for providing lubricant at an intermediate pressure for acting upon the plan view area of said second scroll member shaft.

133. The fluid apparatus as set forth in claim 10 wherein said diameter I is equal to said diameter D, and wherein the plan view area of the second scroll member shaft is exposed to a fluid pressure for pressure balancing of the fluid apparatus.

134. The fluid apparatus as set forth in claim 133 wherein said second scroll member end plate further includes a pressure transmission bore, said pressure transmission bore providing discharge pressure fluid for acting upon the plan view area of said second scroll member shaft.

135. The fluid apparatus as set forth in claim 133 wherein said second scroll member shaft further includes a pressure transmission bore, said pressure transmission bore providing fluid at an intermediate pressure for acting upon the plan view area of said second scroll member shaft.

136. The fluid apparatus as set forth in claim 133 wherein said fluid apparatus further includes means for providing lubricant at discharge pressure for acting upon the plan view area of said second scroll member shaft.

137. The fluid apparatus as set forth in claim 133 wherein said fluid apparatus further includes means for providing lubricant at an intermediate pressure for acting upon the plan view area of said second scroll member shaft.

138. The fluid apparatus as set forth in claim 10 wherein said diameter I is less than said diameter D, and wherein the plan view area of the second scroll member shaft is exposed to a fluid pressure for pressure balancing of the fluid apparatus.

139. The fluid apparatus as set forth in claim 138 wherein said second scroll member end plate further includes a pressure transmission bore, said pressure transmission bore providing discharge pressure fluid for acting upon the plan view area of said second scroll member shaft.

140. The fluid apparatus as set forth in claim 138 wherein said second scroll member shaft further includes a pressure transmission bore, said pressure transmission bore providing fluid at an intermediate pressure for acting upon the plan view area of said second scroll member shaft.

141. The fluid apparatus as set forth in claim 138 wherein said fluid apparatus further includes means for providing lubricant at discharge pressure for acting upon the plan view area of said second scroll member shaft.

142. The fluid apparatus as set forth in claim 138 wherein said fluid apparatus further includes means for providing lubricant at an intermediate pressure for acting upon the plan view area of said second scroll member shaft.

143. The fluid apparatus as set forth in claim 34 wherein said means for biasing said second scroll member end plate further includes a pressure transmission bore defined in said second scroll member end plate, said pressure transmission bore providing discharge pressure fluid for acting upon the plan view area of said second scroll member shaft.

144. The fluid apparatus as set forth in claim 34 wherein said means for biasing said second scroll member end plate further includes a pressure transmission bore defined in said second scroll member end plate, said pressure transmission bore providing fluid at an intermediate pressure for acting upon the plan view area of said second scroll member shaft.

145. The fluid apparatus as set forth in claim 34 wherein said means for biasing said second scroll member end plate is further comprised of means for providing lubricant at discharge pressure for acting upon the plan view area of said second scroll member shaft.

146. The fluid apparatus as set forth in claim 34 wherein said means for biasing said second scroll member end plate is further comprised of means for providing lubricant at an intermediate pressure for acting upon the plan view area of said second scroll member shaft.

147. The fluid apparatus as set forth in claim 36 wherein said means for biasing said second scroll member end plate further includes a pressure transmission bore defined in said second scroll member end plate, said pressure transmission bore providing discharge pressure fluid for acting upon the plan view area of said second scroll member shaft.

148. The fluid apparatus as set forth in claim 36 wherein said means for biasing said second scroll member end plate further includes a pressure transmission bore defined in said second scroll member end plate, said pressure transmission bore providing fluid at an intermediate pressure for acting upon the plan view area of said second scroll member shaft.

149. The fluid apparatus as set forth in claim 36 wherein said means for biasing said second scroll member end plate is further comprised of means for providing lubricant at discharge pressure for acting upon the plan view area of said second scroll member shaft.

150. The fluid apparatus as set forth in claim 36 wherein said means for biasing said second scroll member end plate is further comprised of means for providing lubricant at an intermediate pressure for acting upon the plan view area of said second scroll member shaft.

151. The fluid apparatus as set forth in claim 37 wherein said means for biasing said second scroll member end plate further includes a pressure transmission bore defined in said second scroll member end plate, said pressure transmission bore providing discharge pressure fluid for acting upon the plan view area of said second scroll member shaft.

152. The fluid apparatus as set forth in claim 37 wherein said means for biasing said second scroll member end plate further includes a pressure transmission bore defined in said second scroll member end plate, said pressure transmission bore providing fluid at an intermediate pressure for acting upon the plan view area of said second scroll member shaft.

153. The fluid apparatus as set forth in claim 37 wherein said means for biasing said second scroll member end plate is further comprised of means for providing lubricant at discharge pressure for acting upon the plan view area of said second scroll member shaft.

154. The fluid apparatus as set forth in claim 37 wherein said means for biasing said second scroll member end plate is further comprised of means of providing lubricant at an intermediate pressure for acting upon the plan view area of said second scroll member shaft.

155. The fluid apparatus as set forth in claim 20 wherein said means for biasing said second scroll member end plate is further comprised of an idler shaft having a diameter I having a plan view area exposed to a fluid at a pressure, and a drive shaft having a diameter D.

156. The fluid apparatus as set forth in claim 155 wherein said diameter I is greater than said diameter D, and wherein the plan view area of the second scroll member shaft is exposed to a fluid pressure for pressure balancing of the fluid apparatus.

157. The fluid apparatus as set forth in claim 156 wherein said second scroll member end plate further includes a pressure transmission bore, said pressure transmission bore providing discharge pressure fluid for acting upon the plan view area of said second scroll member shaft.

158. The fluid apparatus as set forth in claim 156 wherein said second scroll member shaft further includes a pressure transmission bore, said pressure transmission bore providing fluid at an intermediate pressure for acting upon the plan view area of said second scroll member shaft.

159. The fluid apparatus as set forth in claim 156 wherein said fluid apparatus further includes means for providing lubricant at discharge pressure for acting upon the plan view area of said second scroll member shaft.

160. The fluid apparatus as set forth in claim 156 wherein said fluid apparatus further includes means for providing lubricant at an intermediate pressure for acting upon the plan view area of said second scroll member shaft.

161. The fluid apparatus as set forth in claim 155 wherein said diameter I is equal to said diameter D, and wherein the plan view area of the second scroll member shaft is exposed to a fluid pressure for pressure balancing of the fluid apparatus.

162. The fluid apparatus as set forth in claim 161 wherein said second scroll member end plate further includes a pressure transmission bore, said pressure transmission bore providing discharge pressure fluid for acting upon the plan view area of said second scroll member shaft.

163. The fluid apparatus as set forth in claim 161 wherein said second scroll member shaft further includes a pressure transmission bore, said pressure transmission bore providing fluid at an intermediate pressure for acting upon the plan view area of said second scroll member shaft.

164. The fluid apparatus as set forth in claim 161 wherein said fluid apparatus further includes means for providing lubricant at discharge pressure for acting upon the plan view area of said second scroll member shaft.

165. The fluid apparatus as set forth in claim 161 wherein said fluid apparatus further includes means for providing lubricant at an intermediate pressure for acting upon the plan view area of said second scroll member shaft.

166. The fluid apparatus as set forth in claim 155 wherein said diameter I is less than said diameter D, and wherein the plan view area of the second scroll member shaft is exposed to a fluid pressure for pressure balancing of the fluid apparatus.

167. The fluid apparatus as set forth in claim 166 wherein said second scroll member end plate further includes a pressure transmission bore, said pressure transmission bore providing discharge pressure fluid for acting upon the plan view area of said second scroll member shaft.

168. The fluid apparatus as set forth in claim 166 wherein said second scroll member shaft further includes a pressure transmission bore, said pressure transmission bore providing fluid at an intermediate pressure for acting upon the plan view area of said second scroll member shaft.

169. The fluid apparatus as set forth in claim 166 wherein said fluid apparatus further includes means for providing lubricant at discharge pressure for acting upon the plan view area of said second scroll member shaft.

170. The fluid apparatus as set forth in claim 166 wherein said fluid apparatus further includes means for providing lubricant at an intermediate pressure for acting upon the plan view area of said second scroll member shaft.

* * * * *

UNITED STATES PATENT AND TRADEMARK OFFICE

CERTIFICATE OF CORRECTION

PATENT NO. : 4,927,339

DATED : May 22, 1990

INVENTOR(S) : Delmar R. Riffe, Peter A. Kotlarek and Robert E. Utter

It is certified that error appears in the above-identified patent and that said Letters Patent is hereby corrected as shown below:

Column 9, line 65, "int he" should be --in the--.

Column 11, line 14, "231-1" should be --230-1--.

Column 12, line 2, "condition" should be --conditions--.

Column 12, line 67, "palte" should be --plate--.

Column 15, line 12, "scroll and plate" should be --scroll end plate--.

Column 16, line 57, "after "80-5" insert --and 100-5--.

Claim 20, Column 21, line 63, "of" should be --on--.

Claim 29, Column 22, line 51, "asset" should be --as set--.

Claim 92, Column 29, line 48, "forst" should be --first--.

Claim 105, Column 30, line 35, "are" should be --area--.

UNITED STATES PATENT AND TRADEMARK OFFICE

CERTIFICATE OF CORRECTION

PATENT NO. : 4,927,339

DATED : May 22, 1990

INVENTOR(S) : Delmar R. Riffe, Peter A. Kotlarek and Robert E. Utter

It is certified that error appears in the above-identified patent and that said Letters Patent is hereby corrected as shown below:

Claim 154, Column 34, line 34, "of means of" should be --of means for--.

Signed and Sealed this

Sixth Day of August, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,927,339

DATED : May 22, 1990

INVENTOR(S) : Delmar R. Riffe, Peter A. Kotlarek and Robert E. Utter

It is certified that error appears in the above-identified patent and that said Letters Patent is hereby corrected as shown below:

In The Claims:

Claim 1, Column 19, line 11, "said first scroll member" should read --said second scroll member--.

Claim 36, Column 23, line 17, "claim 9" should read --claim 18--.

Claim 37, Column 23, line 22, "claim 9" should read --claim 18--.

Signed and Sealed this

First Day of October, 1991

*Attest:*

*Attesting Officer*

HARRY F. MANBECK, JR.

*Commissioner of Patents and Trademarks*